US006698147B2

(12) United States Patent
Bergman

(10) Patent No.: US 6,698,147 B2
(45) **Date of Patent: *Mar. 2, 2004**

(54) VERTICALLY STACKED CONDOMINIUM UNITS

(76) Inventor: George Bergman, 125 Neptune Drive, Apartment 201, Toronto, Ontario (CA), M6A 1X3

( * ) Notice: Subject to any disclaimer, the term of this patent is extended or adjusted under 35 U.S.C. 154(b) by 0 days.

This patent is subject to a terminal disclaimer.

(21) Appl. No.: 10/372,948

(22) Filed: Feb. 26, 2003

(65) Prior Publication Data

US 2003/0150178 A1 Aug. 14, 2003

Related U.S. Application Data

(63) Continuation-in-part of application No. 10/046,898, filed on Jan. 17, 2002.

(51) Int. Cl.[7] ..... E04H 1/04; E04B 1/348

(52) U.S. Cl. ..... 52/234; 52/79.1; 52/236.3; 52/236.5; 52/236.6

(58) Field of Search ..... 52/79.1, 79.7, 52/79.9, 79.11, 79.12, 234, 236.3, 236.4, 236.5, 236.6, 236.7, 236.8, 236.9, 79.2; D25/4

(56) References Cited

U.S. PATENT DOCUMENTS

| | | | | |
|---|---|---|---|---|
| 1,293,377 A | | 2/1919 | Donaldson | 52/289 |
| 3,656,266 A | * | 4/1972 | Tylius | 52/30 |
| 3,750,366 A | | 8/1973 | Rich et al. | 52/79.11 |
| 3,805,461 A | | 4/1974 | Jagoda | 52/79.11 |
| 3,812,637 A | | 5/1974 | Yang et al. | 52/745.03 |
| 3,884,001 A | * | 5/1975 | Tylius | 52/185 |
| 4,041,661 A | | 8/1977 | Hurwitz | 52/169.4 |
| 4,107,886 A | | 8/1978 | Ray et al. | 52/79.11 |
| 4,282,690 A | | 8/1981 | Meheen | 52/79.11 |

(List continued on next page.)

FOREIGN PATENT DOCUMENTS

| | | | |
|---|---|---|---|
| FR | 1024028 A | 3/1953 | 52/236.3 |
| JP | 5-148904 A | 6/1993 | 52/234 |
| JP | 6-193149 A | 7/1994 | 52/236.3 |
| WO | WO-94/09218 A1 | 4/1994 | 52/79.1 |

*Primary Examiner*—Leslie A. Braun
*Assistant Examiner*—Jon Szumny

(57) ABSTRACT

A building structure suitable as a two-unit building module which may be incorporated into a variety of multi-storey commercial or residential buildings. The structure includes two vertically stacked units which each define a respective self-contained space. As a module, the building structure extends downward from a planar ceiling surface which forms the ceiling of an uppermost unit to a planar lower floor surface of the second lower other unit. Together, the pair of stacked units has an overall height equal to two and one-half to three full storeys, and a height selected between twenty-three and thirty-six feet, depending upon the respective building structure (7.5–12 feet). The building module is bordered on each lateral side by load-bearing support pillars or sidewalls which extend the height of the building. An interior dividing bearing wall is positioned within each of the units between the load-bearing sidewalls, and which divide each unit into primary and secondary living areas or spaces. The principal living area of the uppermost unit is positioned directly above and separated from the principal living area of the lower unit by a floor surface which spans between the interior dividing walls and a first one of the sidewalls, and which is located midway between the upper ceiling of the uppermost unit, and the floor surface of the lowermost unit. The remaining secondary area of each unit is defined by the space bordered laterally by the interior dividing wall and second other load-bearing sidewall, with the units divided vertically by two secondary floor surfaces, so as to define three stacked floors of a conventional one-storey height.

19 Claims, 19 Drawing Sheets

U.S. PATENT DOCUMENTS

| | | | | |
|---|---|---|---|---|
| 4,592,175 | A | 6/1986 | Werner | 52/79.9 |
| 5,123,547 | A | 6/1992 | Koch | 211/59.4 |
| 5,433,322 | A | 7/1995 | Williams | 206/443 |
| D381,180 | S | 7/1997 | Schueneman et al. | D34/38 |
| 5,649,632 | A | 7/1997 | Terashima et al. | 211/59.4 |
| D385,080 | S | 10/1997 | Schueneman et al. | D34/38 |
| 5,694,725 | A | 12/1997 | Kaufman et al. | 52/263.3 |
| D400,441 | S | 11/1998 | Warren | D9/456 |
| 5,899,331 | A | 5/1999 | Warren, Jr. | 206/443 |
| 5,934,467 | A | 8/1999 | Gilfert et al. | 206/391 |
| 6,209,839 | B1 | 4/2001 | O'Malley | 248/346.02 |
| 6,261,037 | B1 | 7/2001 | Richards et al. | 410/36 |
| 6,302,671 | B1 | 10/2001 | Gilfert et al. | 425/84 |
| 6,322,034 | B1 | 11/2001 | O'Malley | 248/346.02 |
| 6,393,774 | B1 | 5/2002 | Fisher | 52/79.1 |
| 6,474,613 | B2 | 11/2002 | O'Malley | 248/346.02 |
| 2002/0063194 | A1 | 5/2002 | O'Malley | 248/346.02 |

* cited by examiner

VERTICALLY STACKED CONDOMINIUM UNITS

RELATED APPLICATIONS

This application is a continuation-in-part of U.S. patent application Ser. No. 10/046,898, filed Jan. 17, 2002.

SCOPE OF THE INVENTION

The present invention relates to a building, condominium or townhouse structure which includes two or more vertically stacked building units, and in particular, a stacked building unit construction consisting of at least two self-contained units, each having areas of both conventional ceiling height and areas having higher cathedral or loft-type ceilings and which is further characterized by a planar parallel horizontal uppermost ceiling and lowermost floor surface arrangement.

BACKGROUND OF THE INVENTION

In the development of urban centres over the past century, there has been a corresponding rise in the density and height of not only commercial buildings, but also residential apartment buildings and condominiums as land costs have increased. As a result, in major urban centres it is common to construct multiple dwelling unit condominiums and apartment buildings which consist of a number of vertically stacked units. Such buildings range in height from two or four storeys in the case of low-rise buildings to high-rise towers of thirty storeys or more.

With the progressing densification of cities and increased development, developers are continuously attempting to differentiate each new apartment building or condominium from adjacent properties, in an effort to better attract tenants and prospective buyers. To date, the majority of buildings and condominiums are differentiated from each other by the level of quality of materials which are used to finish not only the individual building or living units themselves, but also common areas such as the building lobbies and hallways. In addition, where space permits, an apartment building or residential condominium building may also house a swimming pool or health club facility to provide an enhanced living space for tenants.

Heretofore, the ceiling heights of individual building units which define the self-contained living spaces for the tenants or condominium owners have remained largely homogeneous, and most typically are selected at between 7.5 and 12 feet. The nature of vertically stacked building unit construction makes it difficult to include within the building customized units which may have individual rooms with higher cathedral or loft ceilings or which otherwise have a differing vertical height from either vertically and/or horizontally adjacent units within the building, or for that matter separate living areas within the unit itself. In particular, to ensure structural stability, it is preferred that the load-bearing walls and/or supports of the building extend vertically from the foundation, and cover vertically the entire height of the building. As a result of concerns of structurally weakening the building, there has been a reluctance to include within buildings, units having differing ceiling height configurations, for fear that this would necessitate additional structural reinforcement and architectural input.

Although some developers may include as top floor or penthouse suites customized units which have increased ceiling height, such units are typically restricted solely to the uppermost floor of a building. The inventor will further explain how two types of vertically stacked condominium units can easily overcome any difficulties and also how easy it will become to include building units with different height configurations at any level of the vertical structure with no additional structural reinforcement or architectural input.

SUMMARY OF THE INVENTION

Accordingly, it is an object of the present invention to overcome the disadvantages of existing building constructions by providing a building structure which may be incorporated into any conventional low-rise or high-rise commercial or residential building without significantly altering the load-bearing walls or support configuration for the building. The building structure includes at least one pair of vertically stacked units. Each unit defines a self-contained space and includes a primary area having a cathedral or loft ceiling which is characterized by a ceiling height of 1.5 storeys from the conventional height, and a secondary area which has a conventional one storey ceiling height. The primary and secondary areas of each pair of stacked units are configured so as to provide the building structure with a planar horizontal uppermost ceiling surface and a planar horizontal lowermost floor surface, covering three conventional storeys in height for a first type A module and 2.5 conventional storeys in height for a second alternate type B of module.

Another object of the invention is to provide an improved building structure which includes at least one pair of vertically stacked units and which are defined laterally by three parallel opposing common sidewalls which function as load bearing walls.

A further object of the invention is to provide a building construction for a condominium, townhouse or apartment building which consists of two vertically stacked units, each having a primary living area having a ceiling height of about 1.5 storeys and a secondary living area having a conventional one storey ceiling height, and which may be incorporated into the building during its construction as a module in place of any three vertically stacked conventional single storey units.

Another object of the invention is to provide a building structure which is characterized by at least one pair of vertically stacked units, each having a primary living area with a cathedral ceiling, and which may be incorporated within the load bearing wall configuration of a building design as a building module, without requiring additional structural reinforcement or significant architectural revision to the building.

Another object of the invention is to provide a building or condominium unit construction which includes two building units, each defining a self-contained living space, and which are positioned vertically adjacent to each other, wherein one of the units has a primary living area with a cathedral-type ceiling of approximately and more preferably exactly 1.5 storeys in height, and a secondary living area which comprises a conventional one-storey height floor. The other unit has a primary living area with a cathedral-type ceiling of 1.5 storeys in height and a secondary living area which comprises two one-storey height floors.

A further object of the invention is to provide a building construction for an apartment building, condominium or townhouse which permits two or more separate prestige level dwelling units to be placed in a vertical arrangement, while using substantially the same vertical superstructure and materials of a conventional low-rise or high-rise building, and which presents parallel and planar upper ceiling and lowermost floor surfaces.

The present invention provides a building structure or construction which is suitable as a two-unit building module which may be incorporated into a variety of multi-storey commercial or residential buildings. The building structure includes two vertically stacked units which each define a respective self-contained space. As a module, the building structure extends vertically downward from a planar ceiling surface which forms the upper extent of the uppermost unit to a planar lower floor surface of the other unit. Together, the pair of stacked units has an overall height equal to three full storeys for a type A module in accordance with a first embodiment of the invention and 2.5 storeys for a type B module in accordance with a second embodiment. Most preferably, the height is selected between twenty-three and thirty-six feet, depending upon the respective building structure (7.5–12 feet).

Laterally, the building module is bordered on each side by load-bearing support pillars or sidewalls (hereinafter collectively referred to as load-bearing walls) which extend the height of the building. An interior dividing load-bearing wall is positioned within each of the units between the load-bearing sidewalls, and which divides each unit into primary and secondary living areas or spaces. Although not essential, most preferably, the interior dividing walls of each unit are vertically aligned directly with each other and operate as an internal load-bearing wall.

For type A building module, the principal living area of the uppermost unit is positioned directly above and separated from the principal living area of the lower unit by a floor surface which spans between the interior dividing bearing wall and a first one of the sidewalls. The floor surface of the upper principal living area is located approximately and more preferably exactly midway between the upper ceiling surface of the uppermost unit, and the floor surface of the lowermost unit. Most preferably, the ceiling height in the principal area of each vertically adjacent unit is approximately or exactly equal to one-half the overall vertical height of the building module.

For type A module, a remaining secondary area of each unit is defined by the space bordered laterally by the interior dividing bearing wall and the second other load-bearing sidewall. The secondary areas of the units are divided vertically by two secondary floor surfaces, so as to define three stacked floors of a conventional one-storey height.

The type A lower unit of the module consists of a primary area having a cathedral-type ceiling and a secondary area consisting of a one storey living area. The type A upper second unit of the module consists of a primary living space with a cathedral ceiling, and a secondary living area which consists of two vertically stacked floors, each of one storey height, and more preferably which are always stacked vertically adjacent to the secondary living area of the other unit.

It is to be appreciated that doorways are formed through the dividing wall in each unit to permit passage between the primary living area and secondary area. To minimize the space required for stairways and stairwells, the uppermost unit is preferably provided with a secondary area which includes the two vertically stacked floors. This configuration advantageously requires that only the upper unit be provided with stairs and a stairwell.

For type B module, the principal living area of the uppermost unit is positioned above the secondary living area of the lower unit and is separated by a floor surface which spans between the interior dividing bearing wall and a first one of the sidewalls. The primary floor surface is located exactly one conventional storey height from the floor surface of the lowermost unit.

For type B module, the secondary living area of the top unit has two different ceiling heights. Accordingly, the first part of the secondary unit that is placed exactly above the primary living area of the bottom unit, covers the exact surface of the primary area of the bottom unit, and is located exactly one-half conventional storey height above the floor surface of the primary portion of the top unit. The totally remaining space of the secondary living area of the top unit is characterized by a height of 1.25 times that of the conventional storey height with its floor surface one-quarter a conventional storey height above the floor surface of the primary portion of the top unit. The above described remaining part of the secondary living area of the top unit is placed exactly above a corresponding remaining portion of the secondary living area of the bottom unit with a 1.25 height between the two vertically adjacent living areas.

The type B upper unit of the module consists of a primary area having a cathedral-type ceiling and a secondary area which consists of two parts with two different heights. The front first part surface of the secondary living area of the top unit is placed above the primary living area of the bottom unit and consists of a one conventional storey height living area. The total remaining rearward area of the secondary living area of the top unit consists of 1.25 height of the conventional storey height and is placed exactly above the back part of the secondary living area of the lower unit. The back part of the secondary living area of the lower unit also consists of 1.25 height of the conventional storey height.

The type B lower unit will display exactly the same basic characteristics (patterns) of the type B upper unit. Accordingly, it consists of a primary area having a cathedral-type ceiling and a secondary living area consisting of two parts with two different heights. The surface of the lower secondary unit area, placed exactly and totally underneath the primary living area of the top unit, consists of one conventional storey height living area. The remaining area of the lower secondary living unit area, placed exactly underneath the secondary living area of the top unit, consists of a 1.25 height from the conventional storey height of the building.

An entrance into the lowermost unit may be provided along the lowermost floor surface of either the primary or secondary areas. The entrance at the top unit will be provided at the upper floor of the secondary area of the top unit for type A and at the 1.25 height secondary area of the top unit for type B.

In the above described modules, each of the building units is accessible from a respective hallway which extends along a rear portion of each unit. Thus, for type A the bottom unit accessibility is from the secondary living area (7.5–12 feet) and accessibility for the top unit is from the top secondary living area (second level of the top unit). For type B the bottom unit accessibility is always from the 1.25 height secondary living area and accessibility for the top unit is always from the 1.25 height portion of the secondary living area.

A primary advantage of the building structure resides in the fact that the ceiling surface of the uppermost unit as well as the floor surface of the lowermost unit is formed as parallel horizontal slabs for both types of modules. Furthermore, insofar as the sidewalls, the middle wall and some portions of the back walls are positioned as vertical load-bearing walls, the configuration of the present building structure advantageously enables its inclusion in almost any conventional building more than three storeys in height (respective 2.5 height for type B), while avoiding the need to incorporate additional architectural reinforcement or specialized designs. Rather, one or more building modules could be incorporated in almost any building construction in place of any three conventional vertically stacked units (respective 2.5 for type B).

The present building structure permits increased adaptability allowing specialized units to be positioned not only at the top storeys of low rise or high rise buildings, but also provides the opportunity to be inserted as mid-storeys or bottom storeys with minimal design changes. Furthermore, it is envisioned that where one side or other portion of a building commands a preferred view, for example overlooking a park or water, an entire side of the building could be formed with upgraded building modules, each module incorporating the pair of units characterized by a primary living area having a cathedral ceiling height and secondary living area of a conventional one-storey height, or conventional 2×1 storey height for the top unit. Similar type of inclusion is available for type B module. Any remainder of the building which does not possess the desired view could be formed with more economical and modestly priced single storey units.

Accordingly in one aspect, the present invention resides in a building structure comprising, at least one pair of units defining a self-contained space, a hallway area for providing access into or from a selected one of the units, the pair of units spaced forwardly from the hallway area, a first one of said units being spaced vertically directly above the second other said unit, said first and second units being laterally defined by a pair of parallel vertically extending sidewalls, and further including an interior central dividing wall interposed between and parallel to said sidewalls, a first planar horizontal slab spanning between said sidewalls and defining an upper ceiling of said first unit, a second planar horizontal slab spaced about 2.5 storeys vertically beneath said first slab, said second slab spanning between said sidewalls and defining a lower floor of said second unit, each of said units further including a forwardmost principal living area defined laterally by a first one of said sidewalls and said dividing wall, a forwardmost secondary living area defined laterally by the dividing wall and the second other one of said sidewalls and a rearward secondary living area located between the hallway area and at least one of the principal living area and the forwardmost secondary living area, the principal living area of the first unit being spaced vertically directly above the forwardmost secondary living area of the second unit and separated therefrom by a horizontally extending principal area floor surface spanning between said dividing wall and said first sidewall, said principal area floor surface being located approximately 1.5 storeys above said second slab, the forwardmost secondary living area of the first unit being spaced directly above and separated from the primary living area of the second unit by a horizontally extending secondary floor surface spaced approximately 1.5 storeys below said first slab, and wherein the hallway area comprises a pair of vertically spaced upper and lower hallways, the upper hallway extending along at least part of the rearward secondary living area of the first unit, and the lower hallway extending along at least part of the rearward secondary living area of the second unit, at least one doorway permitting movement from the upper hallway into the rearward secondary living area of the first unit.

In another aspect, the invention resides in a building construction for an apartment, condominium or townhouse comprising, a pair of building units each defining a self-contained living space, a first one of said units being spaced vertically adjacent to the second other one of said units, each of said first and second units including at opposing lateral ends vertically extending structural sidewalls, and further including an interior vertical dividing wall interposed between and parallel to said sidewalls, a first generally planar horizontal slab spanning between said sidewalls and defining an upper ceiling of said first unit, a second generally planar horizontal slab spaced approximately 22 to 36 feet vertically beneath said first slab, said second slab spanning between said sidewalls and defining a lower floor of said second unit each of said units further including a principal living area defined by a first one of said structural sidewall and said dividing wall, and a secondary living area defined laterally by the central dividing wall and the second other one of said structural sidewall, the principal living area of the first unit being spaced vertically above the principal living area of the second unit and separated therefrom by a horizontal first floor surface spanning between said dividing wall and said first structural sidewall, said first floor surface being located approximately half way between said first slab and said second slab, the secondary living area of the first unit being spaced above and separated from the secondary living area of the second unit by a horizontal second floor surface, said second floor surface being located approximately one third the distance between said first and second slabs, and a horizontal third floor surface spanning between said dividing wall and said second structural sidewall, the third floor surface located said first slab and said second slab.

In a further aspect the invention resides in an apartment, townhouse or condominium building module construction comprising, a pair of units each defining a self-contained living space, a first one of said units being spaced vertically directly above the second other said unit, said first and second units being laterally defined by a pair of most preferable parallel vertically extending sidewalls, and further including an interior vertical dividing wall interposed between and most preferably parallel to said sidewalls, a first generally planar horizontal slab spanning between said sidewalls and defining an upper ceiling of said first unit, a second generally planar horizontal slab spaced vertically beneath said first slab, said second slab spanning between said sidewalls and defining a lower floor of said second unit, each of said units further including a principal living area defined by a first one of said sidewalls and said dividing wall, and a secondary living area defined laterally by the dividing wall and the second other one of said sidewalls, the principal living area of the first unit being spaced vertically directly above the principal living area of the second unit and separated therefrom by a horizontally extending principal area floor surface spanning between said dividing wall and said first sidewall, said principal area floor surface being located approximately half way between said first slab and said second slab, the secondary living area of the first unit being spaced directly above and separated from the secondary living area of the second unit by a horizontally extending secondary floor surface spaced approximately one third the distance between said first and second slabs.

In another aspect, the present invention resides in an apartment, townhouse or condominium building module construction referred to as type A module, and comprising, a pair of units each defining a self-contained living space, a first one of said units being spaced vertically directly above the second other said unit, said first and second units being laterally defined by a pair of parallel vertically extending sidewalls, and further including an interior central dividing wall interposed between and parallel to said sidewalls, a first planar horizontal slab spanning between said sidewalls and defining an upper ceiling of said first unit, a second planar horizontal slab spaced about 3 storeys vertically beneath said first slab, said second slab spanning between said sidewalls and defining a lower floor of said second unit, each of said units further including a principal living area defined laterally by a first one of said sidewalls and said dividing wall, and a secondary living area defined laterally by the dividing wall and the second other one of said sidewalls, the principal living area of the first unit being spaced vertically directly above the principal living area of the second unit and separated therefrom by a horizontally extending principal area floor surface spanning between said dividing wall and said first sidewall, said principal area floor surface being located approximately 1.5 storeys above said second slab, the secondary living area of the first unit being spaced directly above and separated from the secondary living area of the second unit by a horizontally extending secondary floor surface spaced approximately one-third the distance between said first and second slab.

In another aspect, the present invention resides in an apartment, townhouse or condominium building module construction referred to as type B module which is characterized by, a pair of units each defining a self-contained living space, a first one of said units being spaced vertically directly above the second other said unit, said first and second unit being laterally defined by a pair of most preferable parallel vertically extending sidewalls, and further including an interior central dividing wall interposed between and most preferably parallel to said sidewalls, a first planar horizontal slab spanning between said sidewalls and defining an upper ceiling of said first unit, a second planar horizontal slab spaced about 2.5 storeys vertically beneath said first slab, said second slab spanning between said sidewalls and defining the lower floor of said second unit, each of said units further including a principal living area defined laterally by a first one of said sidewalls and said dividing wall, and a secondary living area defined laterally by the dividing wall and the second other one of said sidewalls, the principal living area of the first unit spaced vertically directly above the secondary living area of the second unit, area characterized by a one-storey conventional height between the said second slab and the floor surface of the principal living area of the top unit; the horizontally extending principal area floor surface of the first unit spanning between said dividing wall and said first sidewall, said principal area floor surface being located one conventional storey above said second slab, first part of the secondary living area of the first unit being spaced vertically directly above the secondary living area of the second unit, area characterized by 1.25 from the conventional height between the floor surface of the first part of the secondary living area of the first unit and the said second slab, second part of the secondary living area of the first unit being spaced directly above the principal living area of the second unit, area characterized by 1.5 from the conventional height between the second part of the secondary living area floor surface of the first unit and the said second slab, the first part of the secondary area of the top unit defined laterally by a first one of said sidewalls and the interior dividing wall, the second part of the secondary area of the top unit defined laterally by the two end sidewalls, the floor surface of the second first part of the secondary living area of the top unit located approximately or exactly half-way (1.25) between the said first slab and the said second slab, the floor surface of the said second part of the secondary living area of the top unit located one conventional storey height from the first said slab and 1.5 from the conventional storey height from the second said slab.

BRIEF DESCRIPTION OF THE DRAWINGS

Further objects and advantages of the invention will now become apparent from the following detailed description, taken together with the accompanying drawings in which.

DETAILED DESCRIPTION OF THE PREFERRED EMBODIMENT

Figure 1:
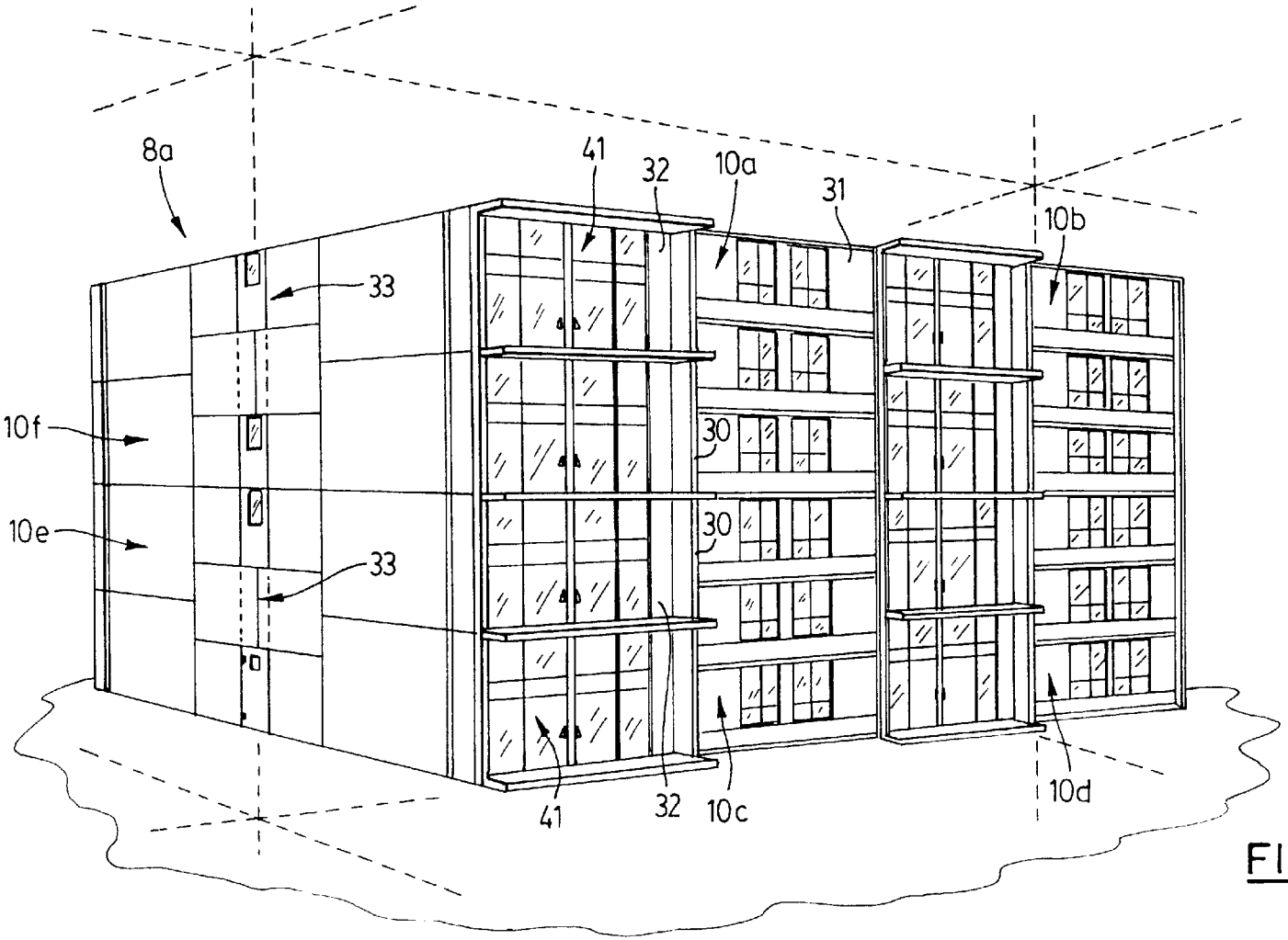
FIG. 1 shows a perspective front view of a building incorporating a number of building construction modules in accordance with a first embodiment of the invention named type A module.

Reference is first made to FIG. 1 which illustrates low-rise residential condominium 8A. The condominium building 8A is of a six storey height and, as will be described, consists of eight identical vertically stacked and laterally positioned building construction modules (modules 10*a–f* shown) in accordance with a first embodiment of the invention named type A module, each of which is approximately or exactly 3 storeys in height.

Figure 2:
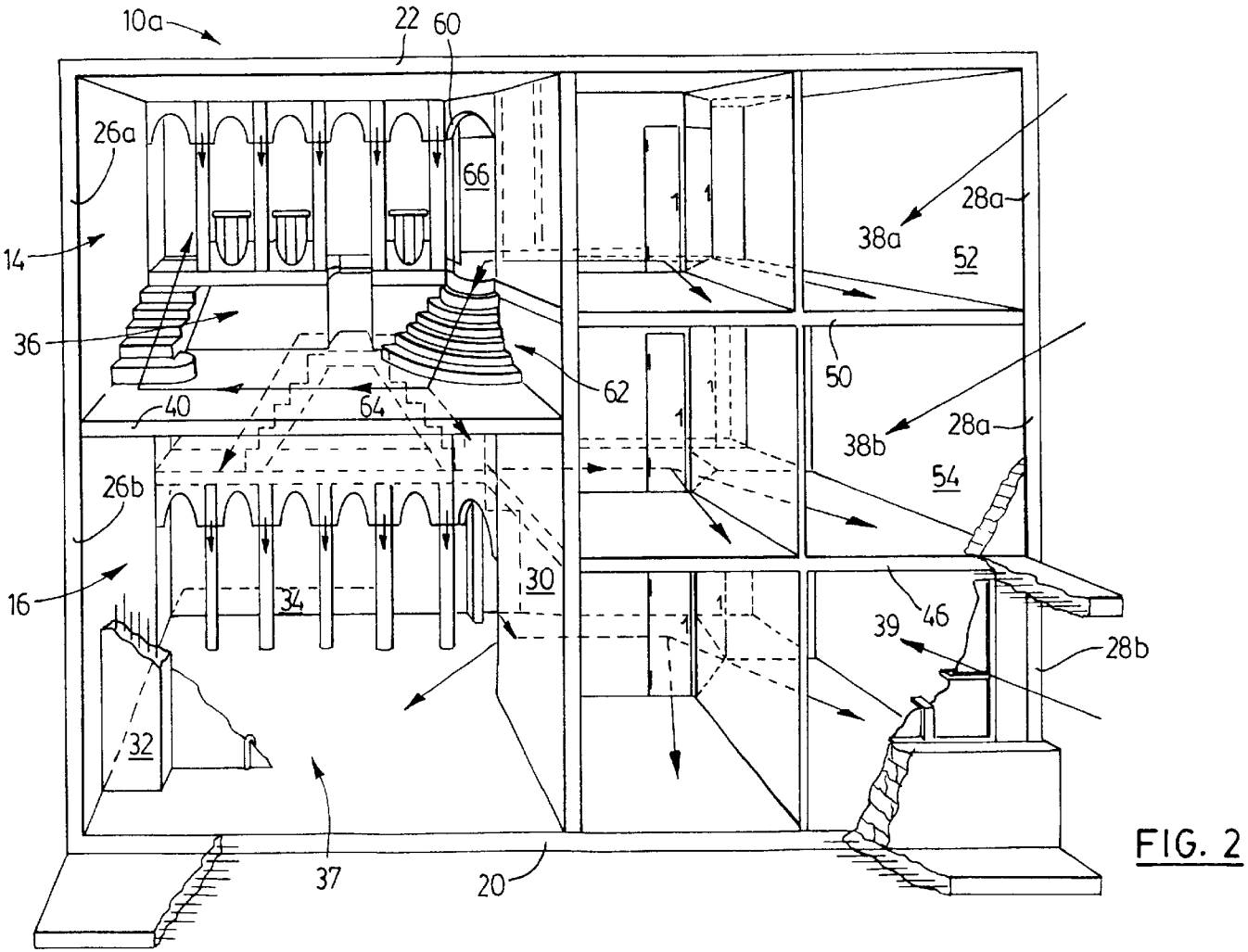
FIG. 2 shows a detailed front view of the layout of a single building construction module used in the building in FIG. 1.

FIG. 2 shows in front view the horizontal floor layout for the individual building construction module 10*a* as used in the construction of the low-rise condominium 8A. Although module 10*a* has been shown for clarity, it is to be appreciated that the remaining modules 10 would be of the identical structure and configuration. The construction module 10*a* is formed having an overall generally rectangular shape which, as will be described, enables its location occupying the fourth to sixth floors of the building 8, respective, the uppermost top three floors of the condominium unit. The building module 10*a* has an approximate height of about three conventional storeys which, depending upon the condominium 8 chosen conventional height, will have an average single storey height of between about 7.5 and 12 feet.

FIGS. 3 to 6 show best the configuration of the individual units 14,16 building construction modules 10 as each including two individual condominium units 14,16, each of which defines a respective self-contained living space. The unit 14 is vertically stacked directly on top of the unit 16, with the individual module 10 extending vertically from a concrete slab floor 20, which defines the lowermost extent of the bottom-most unit 16, to an upper horizontal concrete slab 22 which defines the ceiling surface of the uppermost unit 14. The vertical sides of the module 10 comprise a pair of parallel vertical sidewalls 26,28 which, as will be described, consist of respective pairs of load-bearing sidewalls 26*a,*26*b* and 28*a,*28*b* which act as load-bearing sidewalls for each unit 14,16, respectively.

Figure 4:
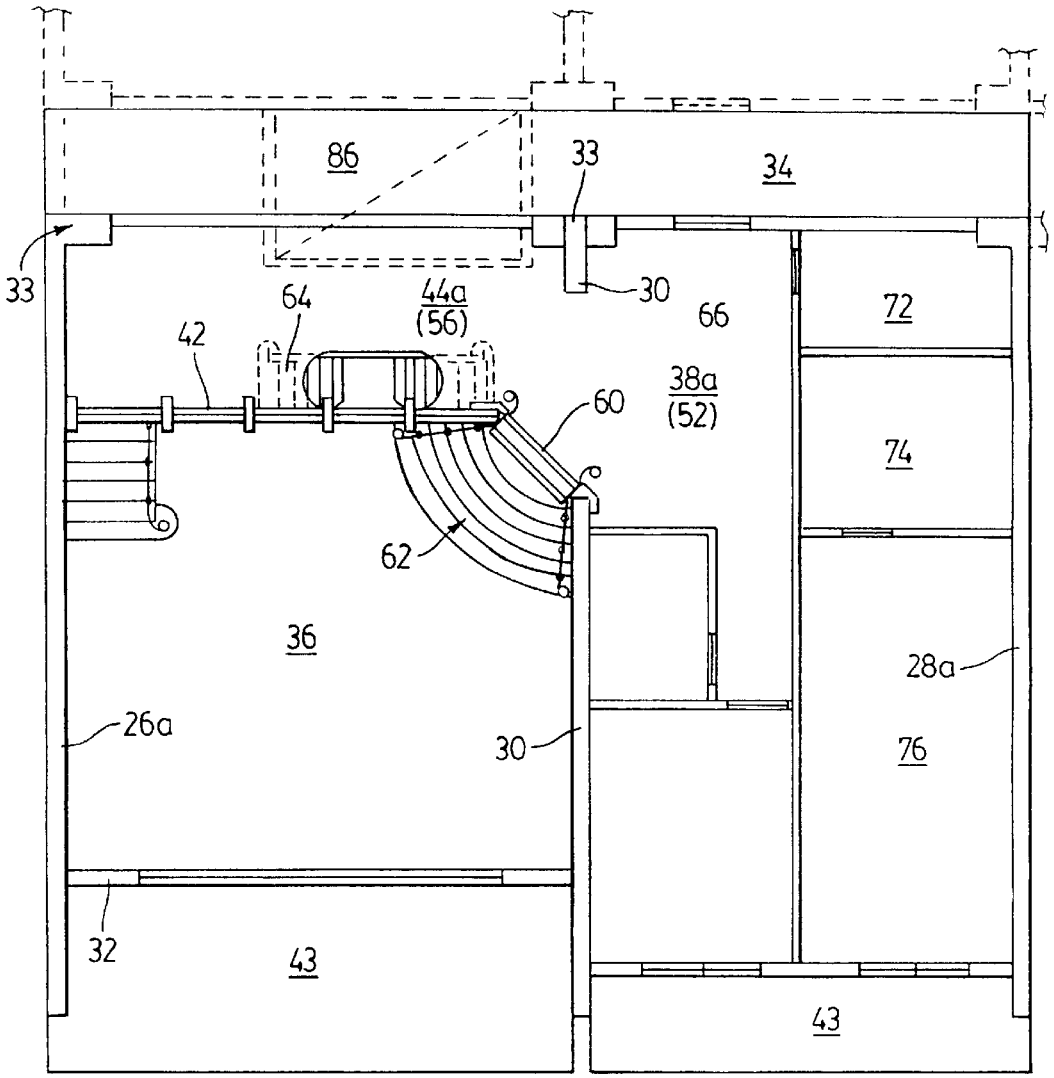
FIG. 4 shows a plan view of the upper unit of the building module shown in FIG. 2 illustrating the uppermost storey layout of the primary and secondary living area.

As shown in the front view of FIG. 2, the units 14,16 have the identical lateral width, each extending laterally from their respective common left side load-bearing sidewall 26*a,*26*b* to the opposing parallel right side load-bearing sidewall 28*a,*28*b*. It is to be appreciated that the load-bearing sidewalls 26*a,*26*b* and 28*a,*28*b* are positioned in direct vertical alignment with not only each other, but also the load-bearing sidewalls 26,28 of other vertically adjacent modules 10*c* (FIG. 1) so as to extend substantially the vertical height of the building. The sidewalls 26*a,*26*b* and 28*a,*28*b* are oriented parallel to each other and extend from an outer face 32 (FIG. 1) of the building 8, rearwardly to a rear wall 33 (FIG. 4). As shown best in FIGS. 4 to 6, the rear wall 33 borders a common building hallway area 34, which permits access to the individual units 14,16.

In the case of buildings 8 more than four conventional storeys in height, the load-bearing walls 26,28 of the building 8A most preferably consist of poured concrete walls which are positioned directly above and vertically aligned with concrete walls extending upwardly from the foundation of the building 8A to provide the maximum degree of support and structural integrity. It is to be appreciated, however, that reference to "load-bearing wall" includes not only continuously poured concrete walls, but also walls which consist of load-bearing supports or posts and other non-structural elements.

The horizontal width of each module 10 is additionally divided internally by a respective load-bearing partition wall 30 which extends from the floor 20 to the ceiling slab 22. The partition wall 30 most preferably is vertically aligned with the partition walls 30 of other vertically spaced modules 10, and although not essential, most preferably is oriented parallel to the sidewalls 26,28. The partition wall 30 extends rearwards from the building face 31 a distance part way towards the rear wall 33 (FIG. 1), and separates the units 14,16 laterally into respective primary living areas 36,37 and secondary living areas 38*a,*38*b,*39.

As shown best in FIG. 2, the primary living area 36 of the upper unit 14 is located directly above the primary living area 37 of the lowermost unit 16. The primary living areas 36,37 of the units 14,16 are separated from each other by a floor slab 40 formed mid-way between the lower concrete slab 20, and the ceiling slab 22. Furthermore, the slab 40 acts as the ceiling of the lowermost primary living area 37, and its positioning provides each primary living area 36 with a loft or cathedral-type ceiling having a height ranging approximately between 12 and 18 feet, depending upon the overall vertical height of the module 10.

Figure 5:
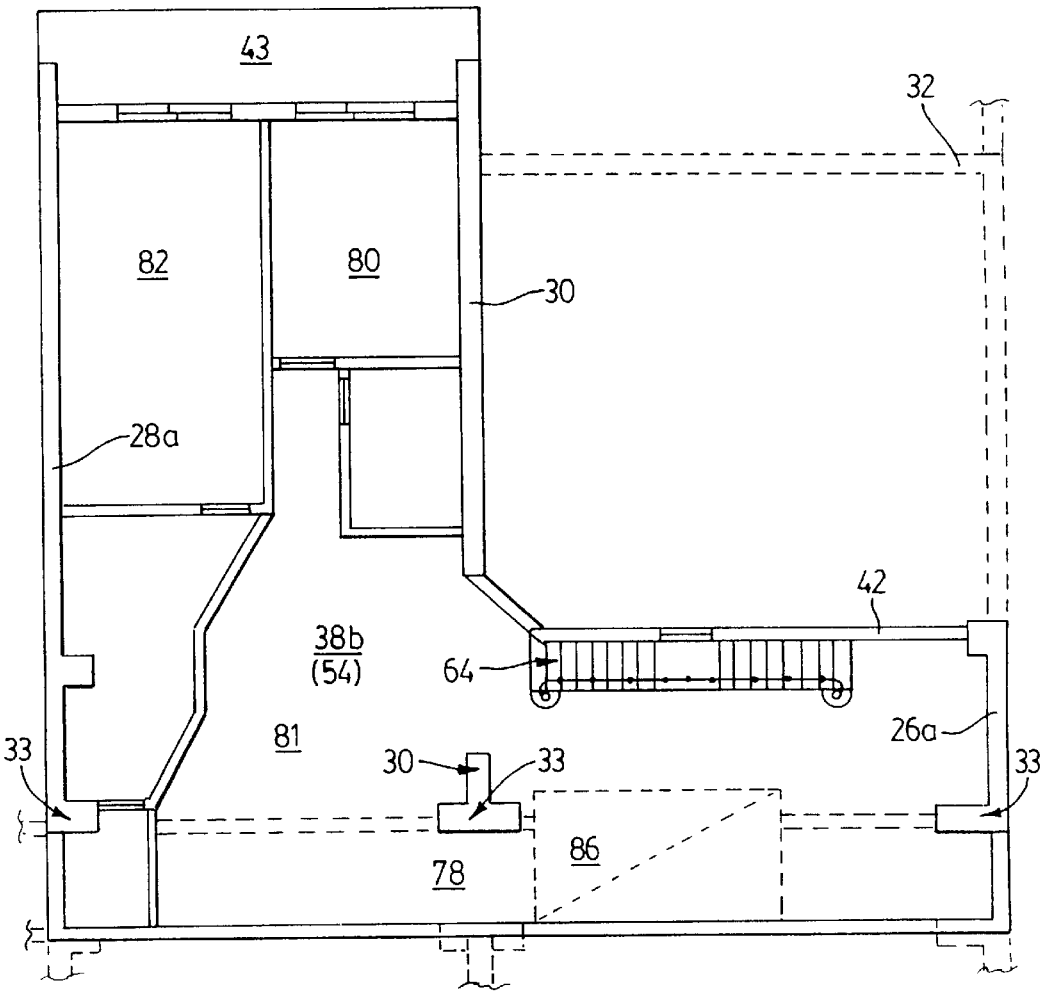
FIG. 5 shows a plan view of the upper unit of the building module of FIG. 2 illustrating the lowermost storey layout of the secondary living area.
Figure 6:
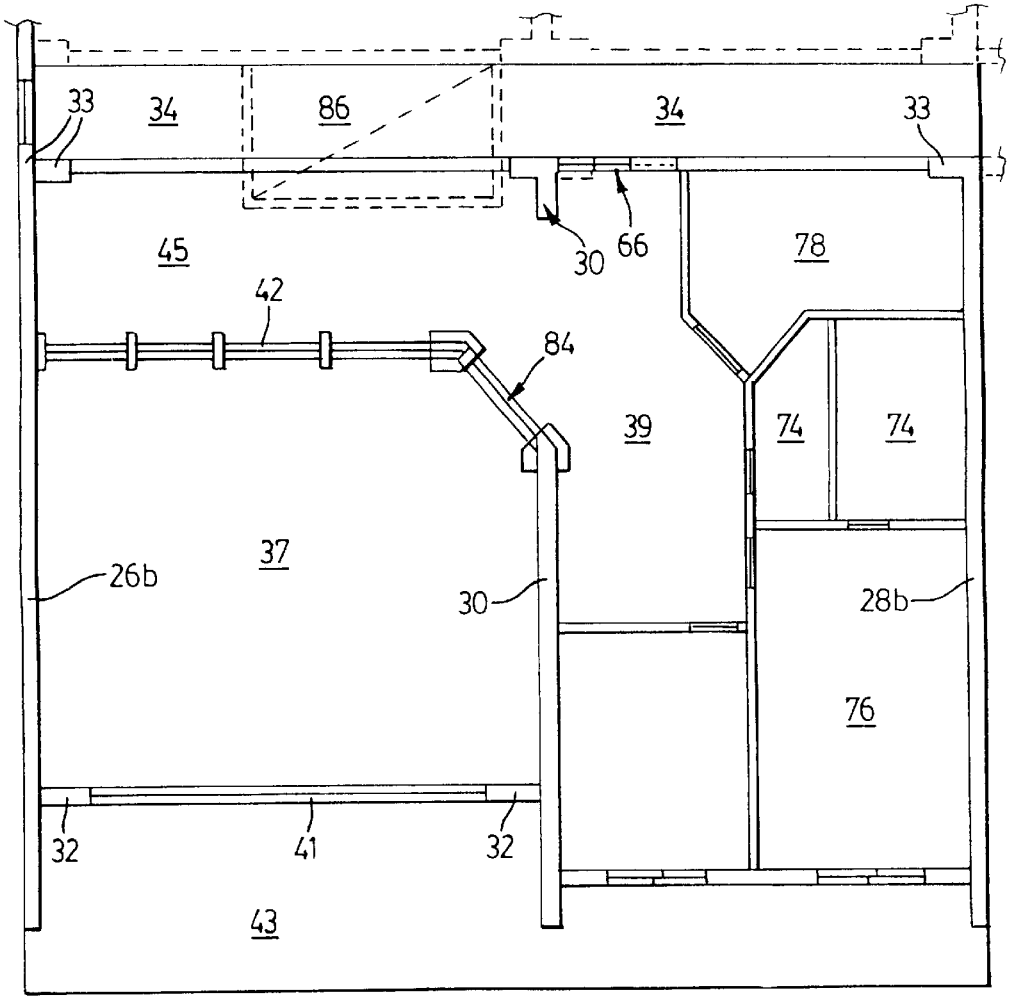
FIG. 6 shows a plan view of the lower unit of the building construction module shown in FIG. 2 illustrating the lower storey layout of the primary and secondary living area.
Figure 7:
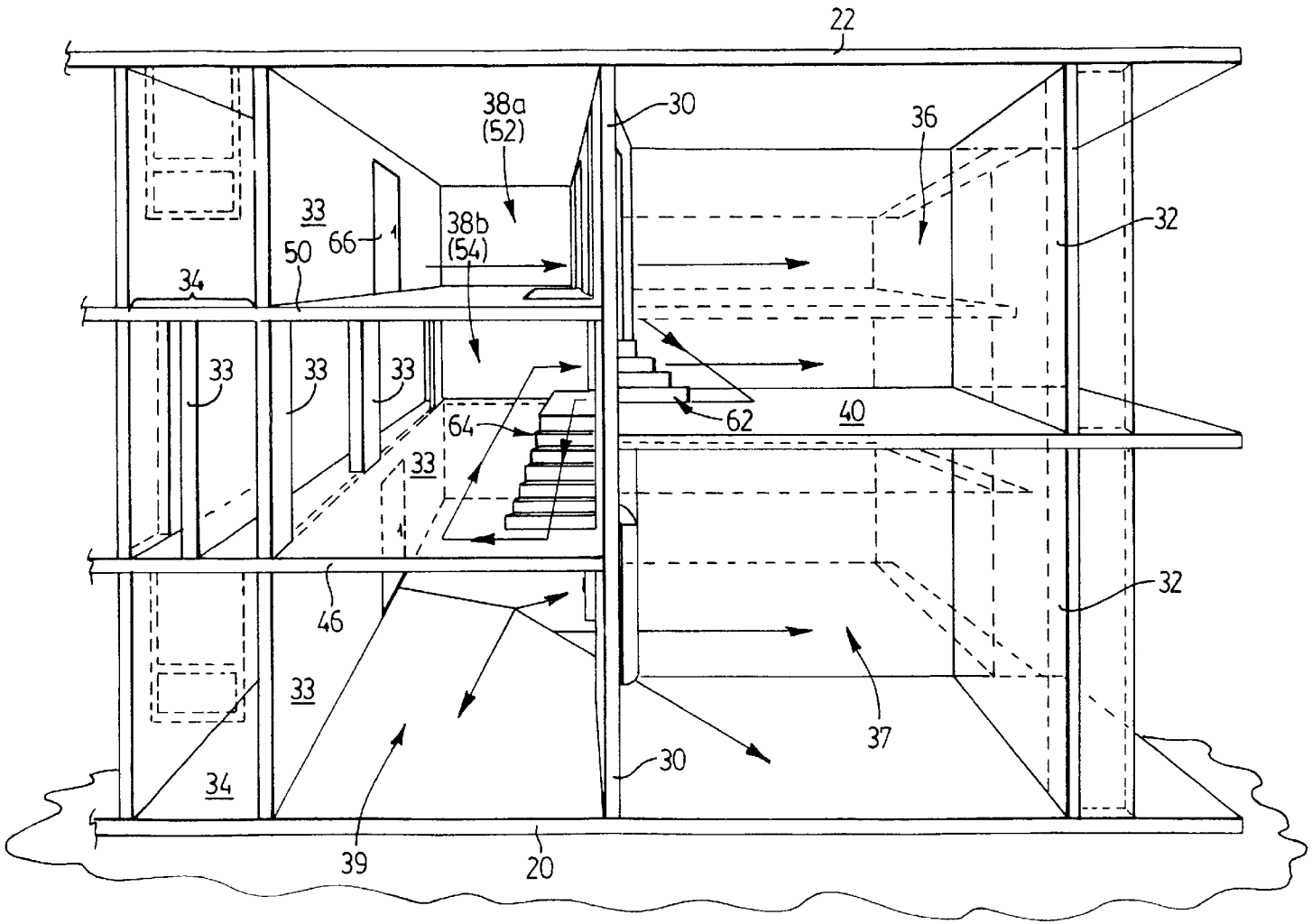
FIG. 7 illustrates a cross-sectional view of a building construction module shown in FIG. 3 taken along line 7–7'.

FIGS. 4 to 6 show the concrete slabs 20,40,46,50 as projecting forwardly from the front walls of each floor of the primary and secondary living areas to function as terraces 43 or balconies. It is to be appreciated that the projecting floor slabs may be omitted, or in an alternate arrangement, the projecting portions of the slabs 20,40,46,50 could be enclosed as a sunroom or other living area.

As shown best in FIGS. 4 to 6, at their rearwardmost extent, the primary living areas 36,37 of both of the units 14,16 are bordered by an internal vertical wall 42 which is positioned in an orientation generally perpendicular to the sidewall 26. The internal wall 42 is spaced forwardly from the rearwall 33 a distance selected to define a respective secondary rear unit hallway area 44*a,*44*b,*45 behind the primary living area 36,37 in each unit 14,16.

Figure 3:
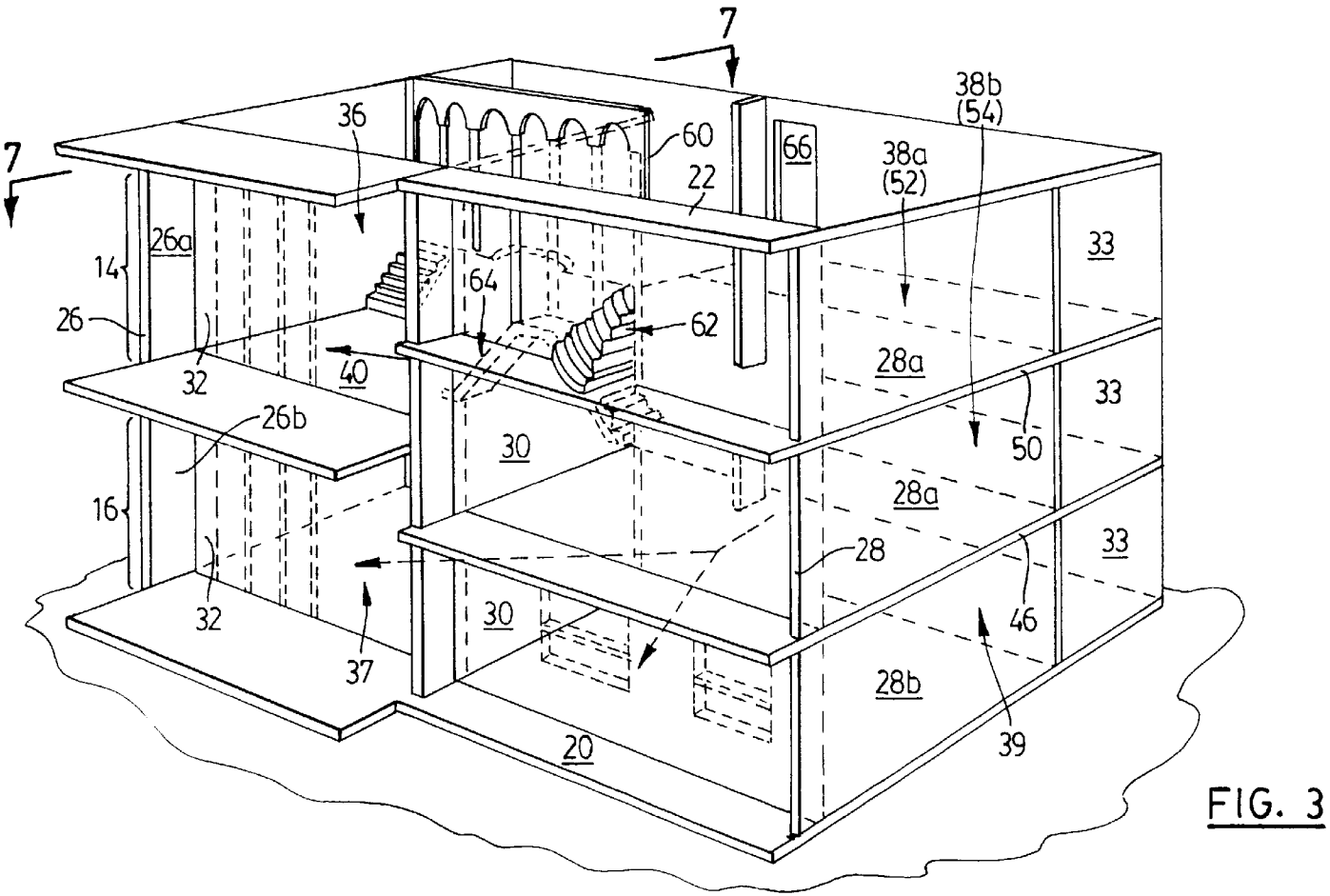
FIG. 3 shows a front perspective view of the module of FIG. 2.

The secondary living area 39 of the lower unit 16 is delineated at its upper extent by a concrete slab 46 which spans the distance between the dividing wall 30 and the right-hand sidewall 28. In addition to forming a ceiling surface for the secondary living area 39, the slab 46 functions as the lowermost floor surface for the secondary living area 38*b* of the upper unit 14. As shown in FIGS. 2 and 3, the slab 46 is most preferably located approximately one-third of the distance between the floor slab 20 and ceiling slab 22 of the module 10. In this position, the slab 46 provides the secondary living area 39 of the lowermost unit 16 with a ceiling height of approximately one standard storey and most preferably approximately 7.5 to 12 feet. Most preferably, as shown in FIG. 2 the slab 46 further extends laterally behind the primary living area 37 of the lower unit 16 as the ceiling surface of the rear hallway area 45, and separates the rear hallway area 44*b* of the upper unit 14 from the area 45 of the lower unit 16. It is to be appreciated that with this configuration a portion of the upper unit 14 drops approximately 0.5 storeys behind the primary living area 37 of the lower unit 16.

Both the secondary living area 38*a*,38*b* and rear hallway area 44*a*,44*b* of the upper unit 14 are further sub-divided vertically by a second horizontal concrete slab 50 which spans between the dividing wall 30 and the second load-bearing wall 28. The slab 50 is positioned mid-way between the floor slab 46 and the ceiling slab 22, thereby dividing the upper unit secondary living area 38 into 38*a* and 38*b* single storey upper and lower floors 52,54. Like the slab 46, the slab 50 extends rearwardly behind primary living area 36 to the left load-bearing wall 26, dividing the hallway area 44*a* and 44*b* into upper and lower hallways 56,58 (FIG. 2).

FIGS. 2 and 3 show best a doorway 60 as being provided at the junction of the upper hallway 56 and the dividing wall 30. The doorway 60 leads to a rise of stairs 62 extending 0.5 storeys in height and providing access between the primary living area 36 of the upper unit 14 and its upper storey 52 and hallway 56. A second stairwell 64, 0.5 storey in height, leads from the primary living area 36 to the lower hallway 58, to enable movement between the primary living area 36 and the lower storey 54. It is to be appreciated, however, that if desired other stair configurations and locations could also be incorporated.

FIG. 4 shows best an entrance door 66 as being provided in the upper hallway 56 and permitting access to and from the unit 14 into the common hallway area 34. If desired, a second entrance way could also be provided on the lower storey 58.

FIG. 4 shows best the plan view of the second storey 56 for the upper unit 14 with the hallway 56 extending above the stairwell 64. In the configuration as shown, the upper floor 52 includes a closet 72 as well as washrooms 74 and bedrooms 76. Similarly, FIG. 5 shows the lower floor 54 as including a kitchen 78, bedroom 80, and library plus den 81 and bedroom 82. It is to be appreciated that other room configurations could also be used. Although not shown, either the hallway 58,56 could, for example, include additional storage areas, powder rooms, or the like.

The layout for the lower unit 16 is seen best in FIG. 6. A doorway 84 provides access between the primary living area 37 of the lower unit 16 and its secondary living area 39. The secondary living area 39 further includes an entrance doorway 66 providing access to the common hallway 34. As in the upper unit 14, the secondary living area 39 of the lower unit 16 houses a library 78 as well as washrooms 74 and bedrooms 76. It is envisioned that the primary living area 36,37 of each unit 14,16 could, for example, function as a living room or great room area. Although not essential, the primary living areas 36,37 could include floor to ceiling windows 41 (FIG. 1) and/or the terrace walkouts 43 could be omitted, depending on the overall look of the building 8A to be achieved.

In the case of a low-rise building 8A, stairs 86 (FIGS. 4 to 6) may be provided in the common hallway 34 to allow floor access. It is to be appreciated that other internal and external stair configurations may also be possible, including a stair construction housed entirely within the units 14,16, without departing from the spirit and scope of the invention.

The lateral extent of the building module 10 may be selected at almost any size. When the building module 10 is included within a building having a number of vertically stacked conventional one storey units, most preferably the module 10 has a lateral extent corresponding to that of any other vertically and/or horizontally adjacent conventional units.

The building construction modules 10 provide a profile which enables its installation in a building in place of any three vertically aligned one storey units, without altering the configuration of the load-bearing supports or walls. Furthermore, insofar as each construction module 10 includes planar and parallel lower and upper slabs 20,22, the module 10 could be provided virtually anywhere in the building, using existing construction techniques. As such, the building construction module 10 of the present invention allows the comparatively simplified incorporation of premium or luxury dwelling units in place of three vertically stacked one storey units almost anywhere within condominium building 8A, without requiring structural modifications or significant architectural changes. Because the building module 10 is characterized by planar parallel surfaces 20,22, the module 10 may be incorporated in a building 8A at almost any location with virtually no change in the load forces applied to load-bearing walls 26,28,30.

Although the preferred type A embodiment of the invention discloses the upper unit 14 as having a secondary living area 38 divided into upper and lower storeys 54,52, the invention is not so limited. It is to be appreciated that the secondary living area 39 of the lower unit 16 could consist of the two one storey floors, with a corresponding placement of the stairwell therebetween. In such a configuration, access to the upper unit 14 would be achieved through the hallway 58 at the third floor level of the module 10.

Similarly, although the detailed description illustrates the building units 14,16 as consisting respectively of a single primary living area 36,37 and a single secondary living area 38,39 the invention is not so limited. If desired, each unit 14,16 could also include additional secondary and/or primary living areas spaced laterally on either side of the load-bearing walls 26,28.

Although for clarity, the module 10*a* shown in FIG. 2 is described as having a concrete floor 20 and left and right side-walls 26,28, it is to be appreciated that the floor 20 and ceiling 22 of a given module 10 would also function as the ceiling and floor of a next vertically spaced lower and upper module 10. Similarly, the left and right sidewalls 26,28 would also function as a common load-bearing sidewall 28,26 of a next horizontally adjacent left or right positioned module 10.

Although FIGS. 1 to 9 illustrate the building module 10 as being used in a low-rise building 8A, it is to be appreciated that the invention is not so limited. If desired, one or more modules 10 could equally be incorporated in high-rise buildings in place of corresponding three vertically stacked one-storey units.

Reference may be made to FIGS. 10 to 16 which show a building 8B incorporating a number of building construction modules 100*a–f* in accordance with a second embodiment of the invention, and wherein like reference numerals are used to identify like components. The modules 100*a–f* are of an identical or mirror construction and consist of upper and lower units 14,16 which, like the embodiment shown in FIGS. 1 to 9, each include a respective forwardmost primary living area 36,37 and a secondary living area 38,39.

Figure 10:
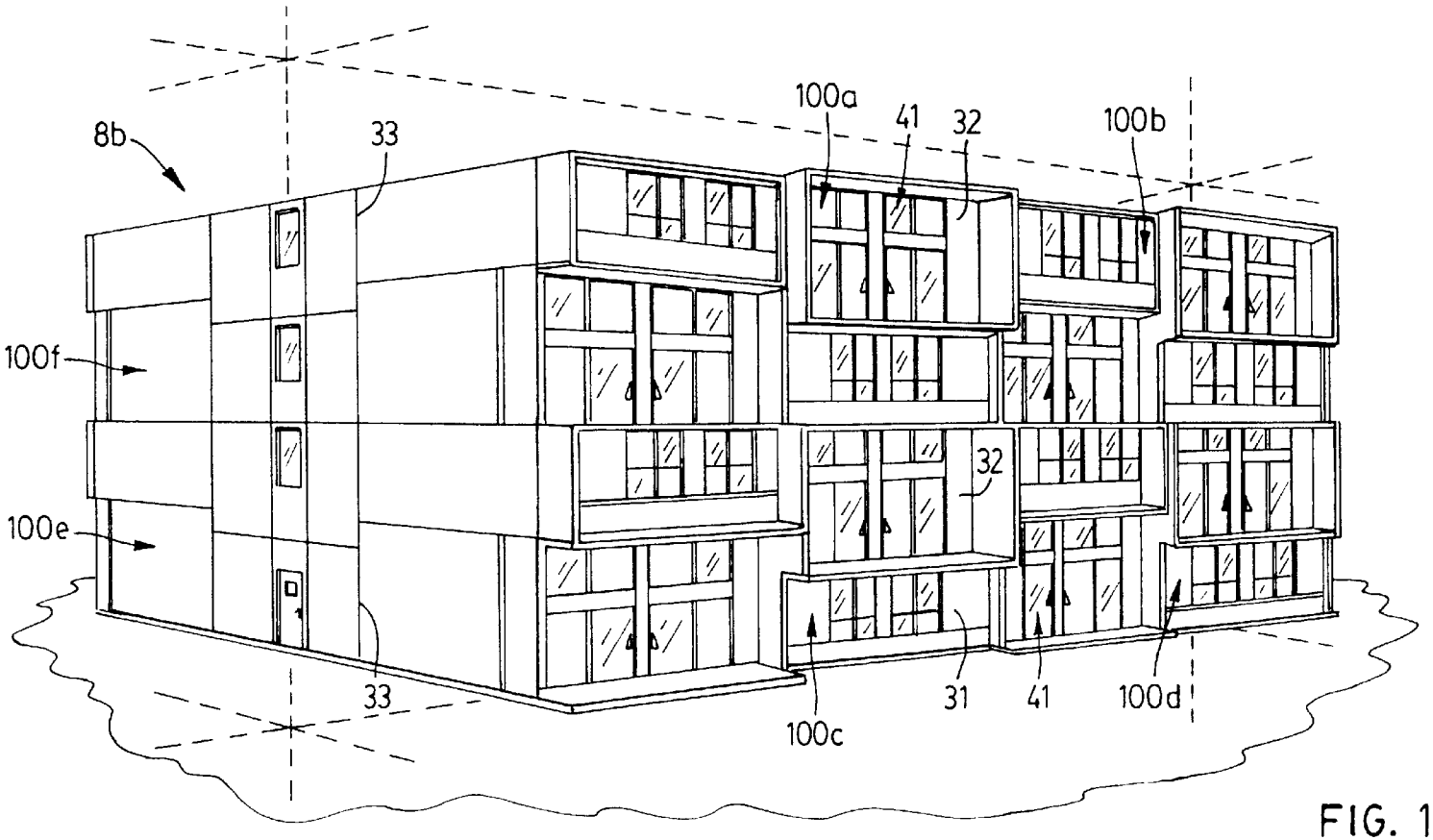
FIG. 10 shows a perspective front view of a building incorporating a number of building construction modules in accordance with a second embodiment of the invention named type B module.

The module 100 of FIG. 10 has an overall height of approximately 2.5 conventional storeys with the forwardmost secondary living area 38, of the unit 14 consisting of a single one-storey unit positioned vertically directly above the primary living area 37 of the second other unit 16. The forwardmost secondary living area 39 of the lower unit 16 is positioned directly below the primary living area 36 of the upper unit 14. This configuration advantageously provides the primary living area 36,37 of each unit 14,16 with a cathedral height ceiling of 1.5 storeys.

The secondary living area 38 of the unit 14 is separated from the primary living area 37 of the unit 16 by a floor slab 48*a* (FIG. 1) formed one conventional storey height from the ceiling slab 22 and 1.5 from the conventional storey height above the lower concrete slab 20. The primary living area 36 of the unit 14 is separated from the secondary living area 39 of the unit 16 by a floor slab 48*b* formed 1.5 from the conventional storey height from the ceiling slab 22 and one conventional storey height above the lower concrete slab 20.

Figure 14:
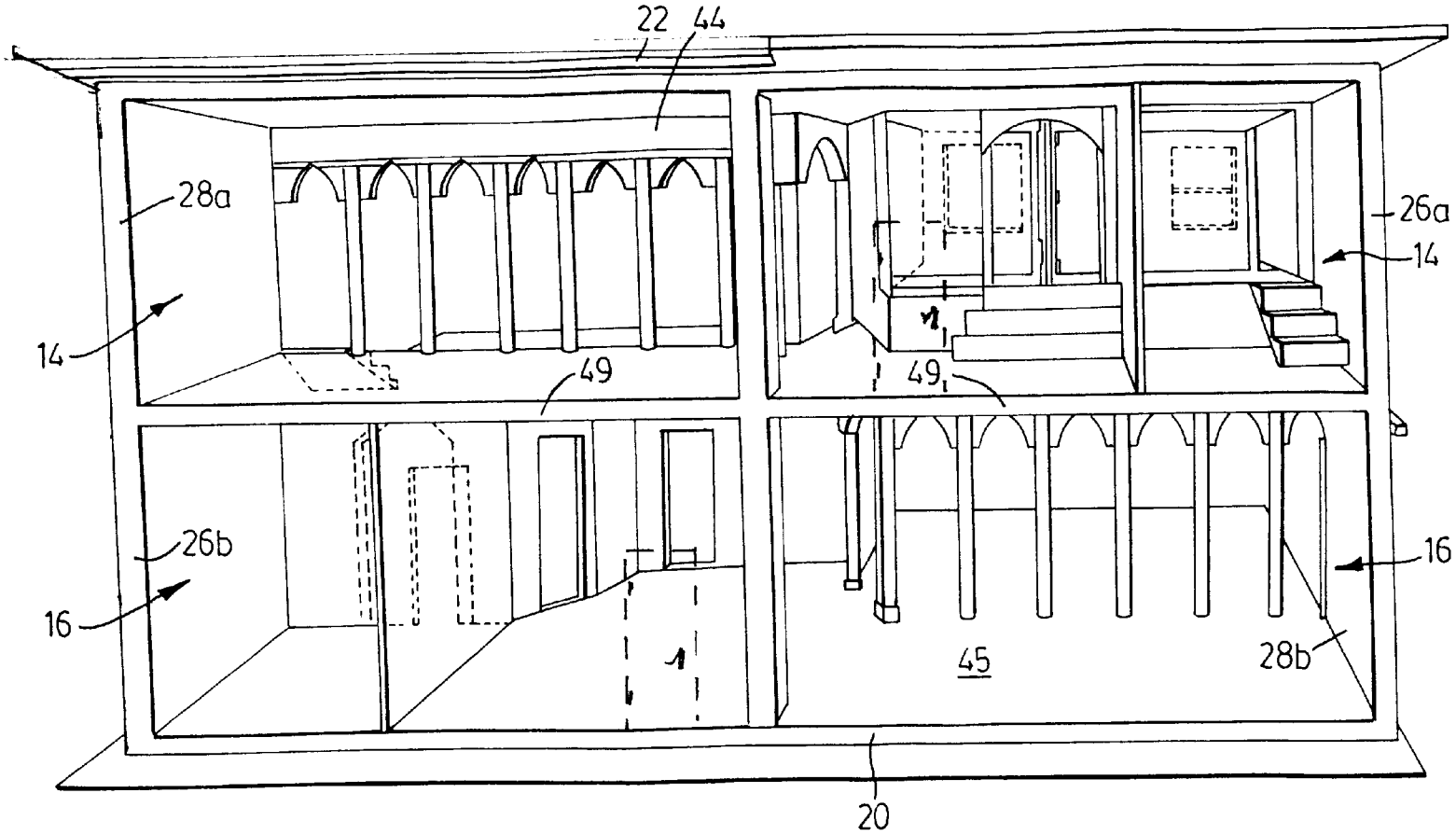
FIG. 14 shows a detailed back view of the layout of a simple building construction module shown in FIG. 1.
Figure 15:
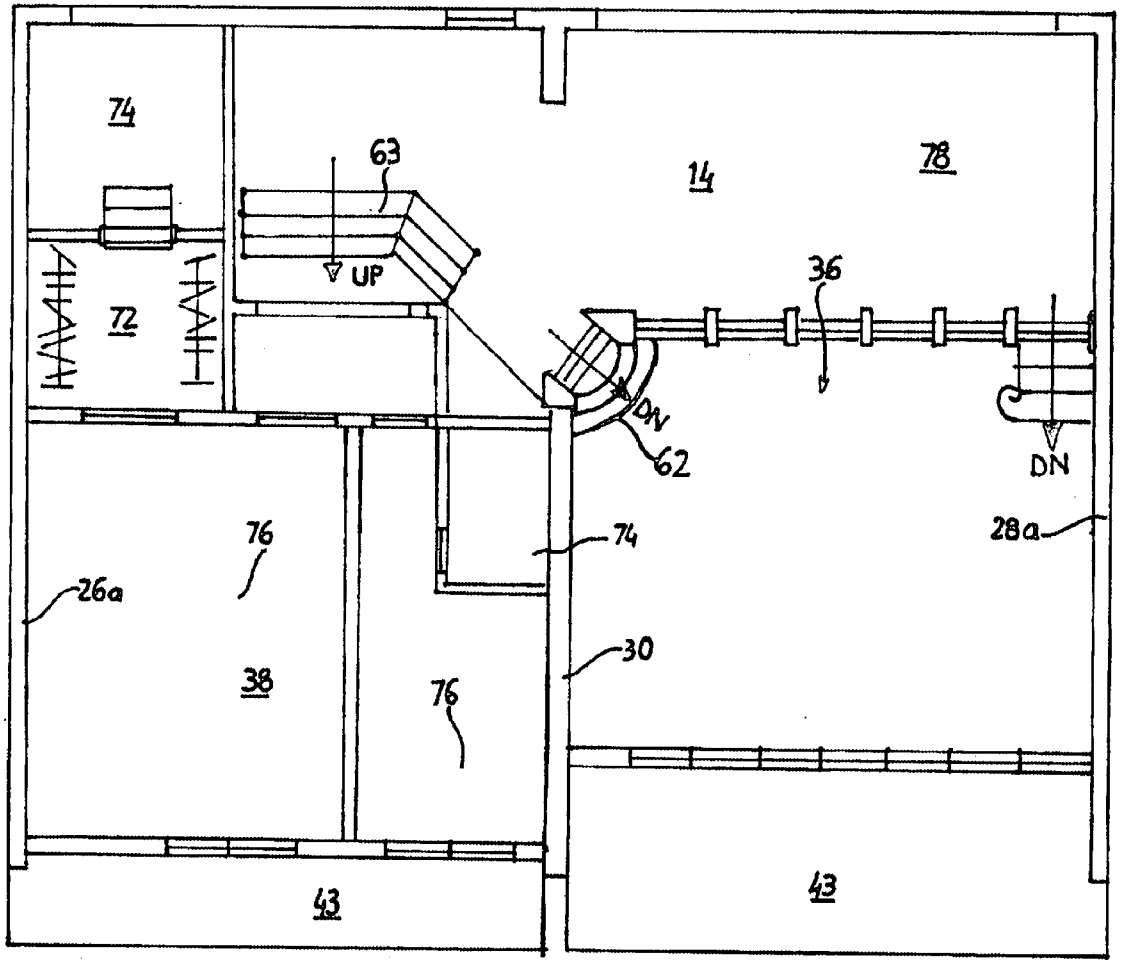
FIG. 15 shows a plan view of the upper unit of the building module shown in FIG. 11 illustrating the layout of the primary and secondary living area.
Figure 16:
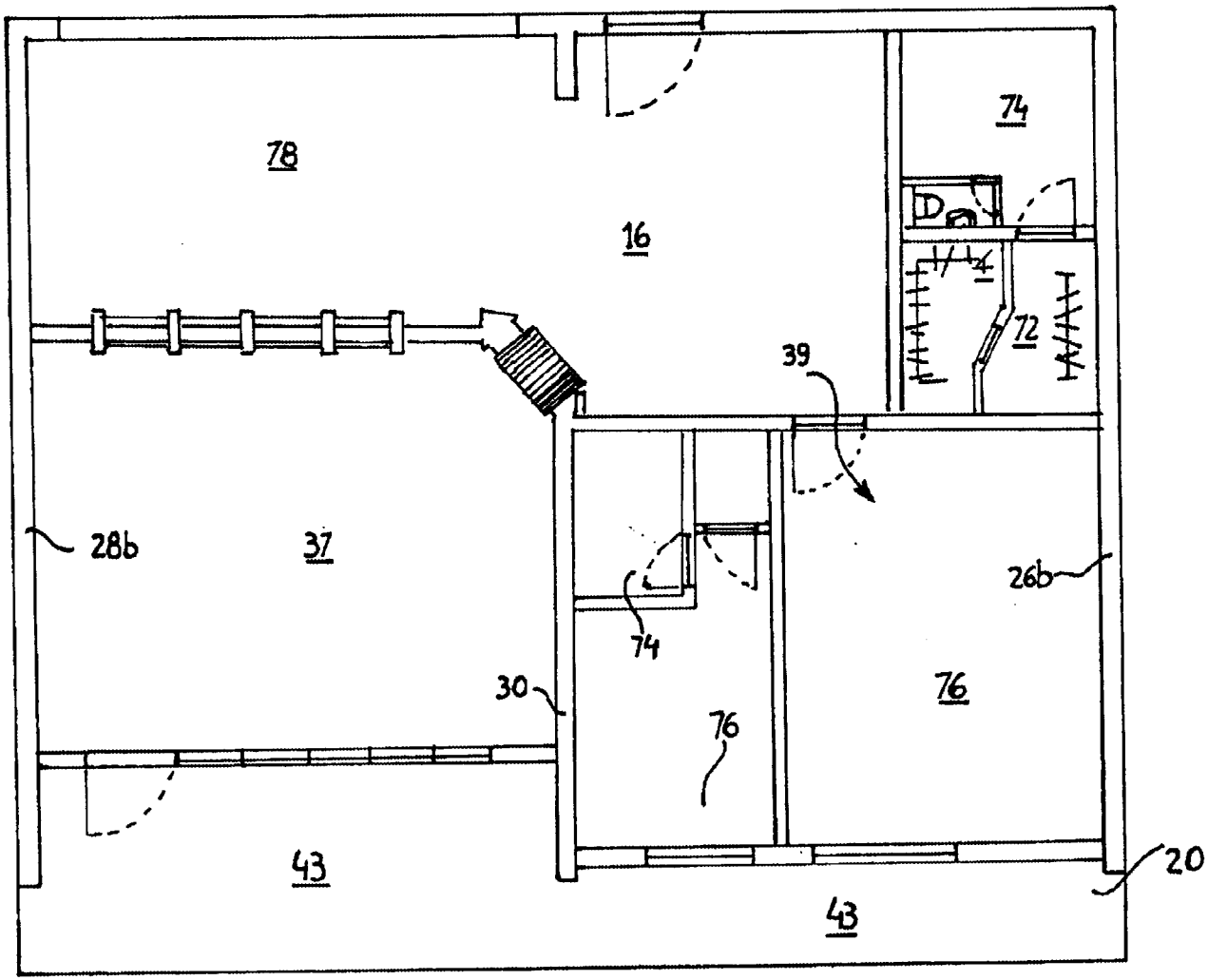
FIG. 16 shows a plan view for the lower unit of the building module shown in FIG. 11 illustrating the layout of the primary and secondary living area.

As with the earlier described module 10, a secondary rear living or unit hallway area 44,45 is provided behind the forward primary and secondary living areas 36,38 and 37,39 of each unit 14,16, respectively. The hallway areas 44,45 extend laterally between a rear wall 33 of each unit 14,16 and their respective primary and secondary living areas 36,38 and 37,39, and in one possible construction may possibly incorporate kitchens 78, washroom 74 and or closets. Vertically, the hallway areas 44,45 are separated by a concrete slab 49. FIG. 14 shows the concrete slab 49 placed approximately or exactly midway between the upper and bottommost slabs 22,20 and spanning (horizontally) between the load-bearing walls 26,28 of the building 8B. It is to be appreciated that with this configuration, both of the rear hallway areas 44,45 have a ceiling height of approximately 1.25 storeys in height.

Figure 8:
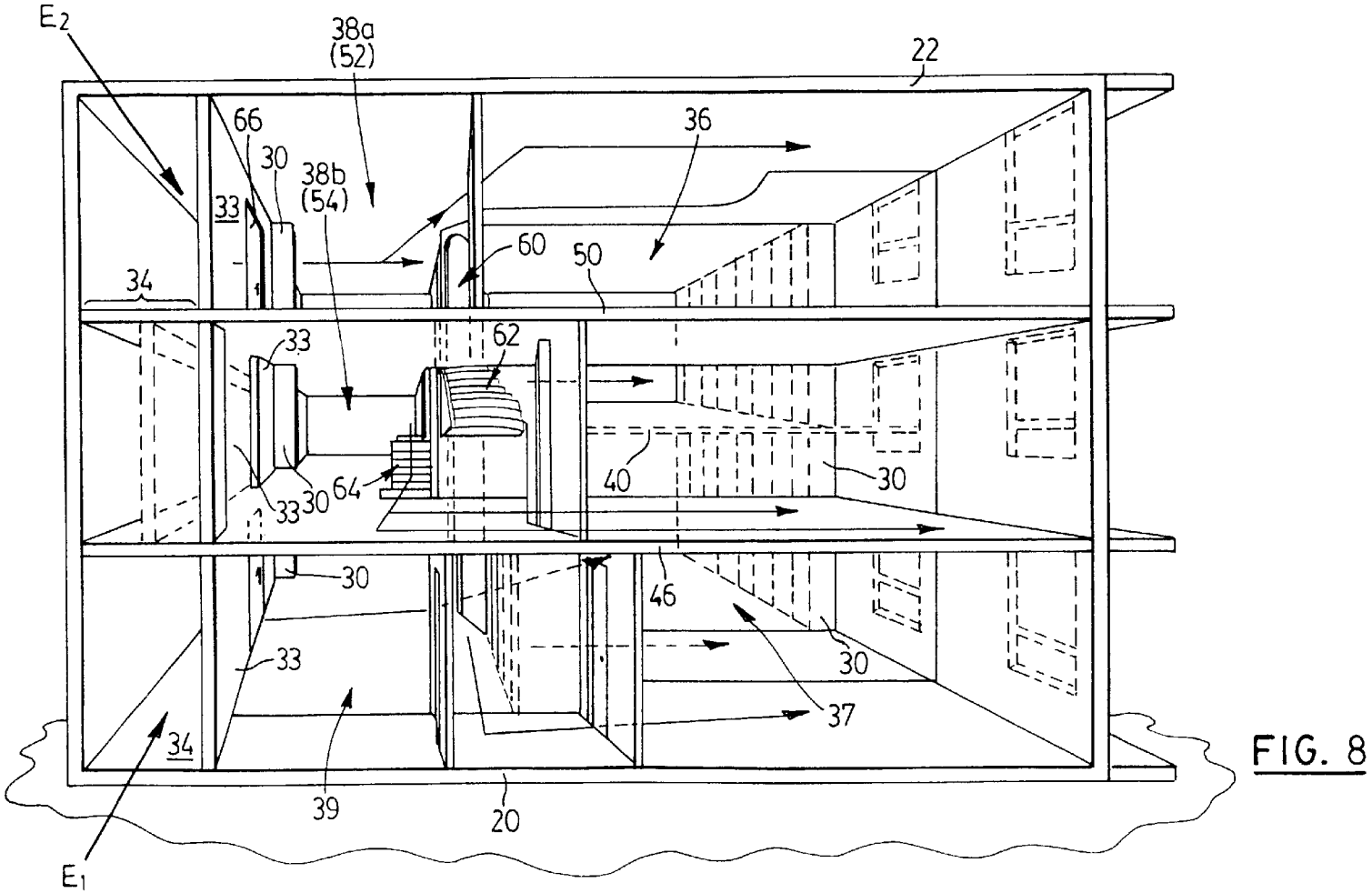
FIG. 8 illustrates a right side view of the building construction module in accordance with the first embodiment of the invention.
Figure 9:
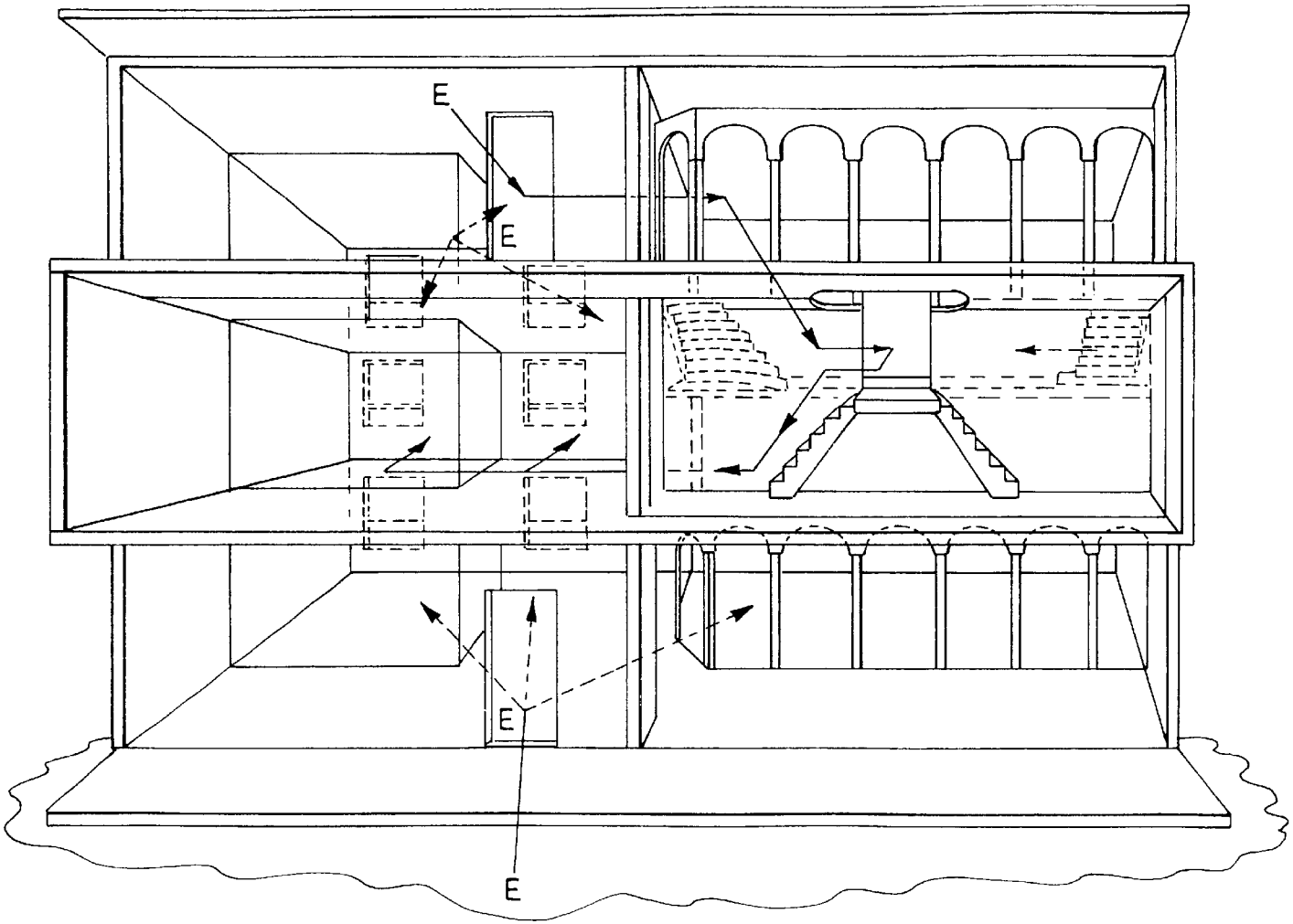
FIG. 9 illustrates a detailed back view of the layout of a single building construction module shown in FIG. 2.
Figure 11:
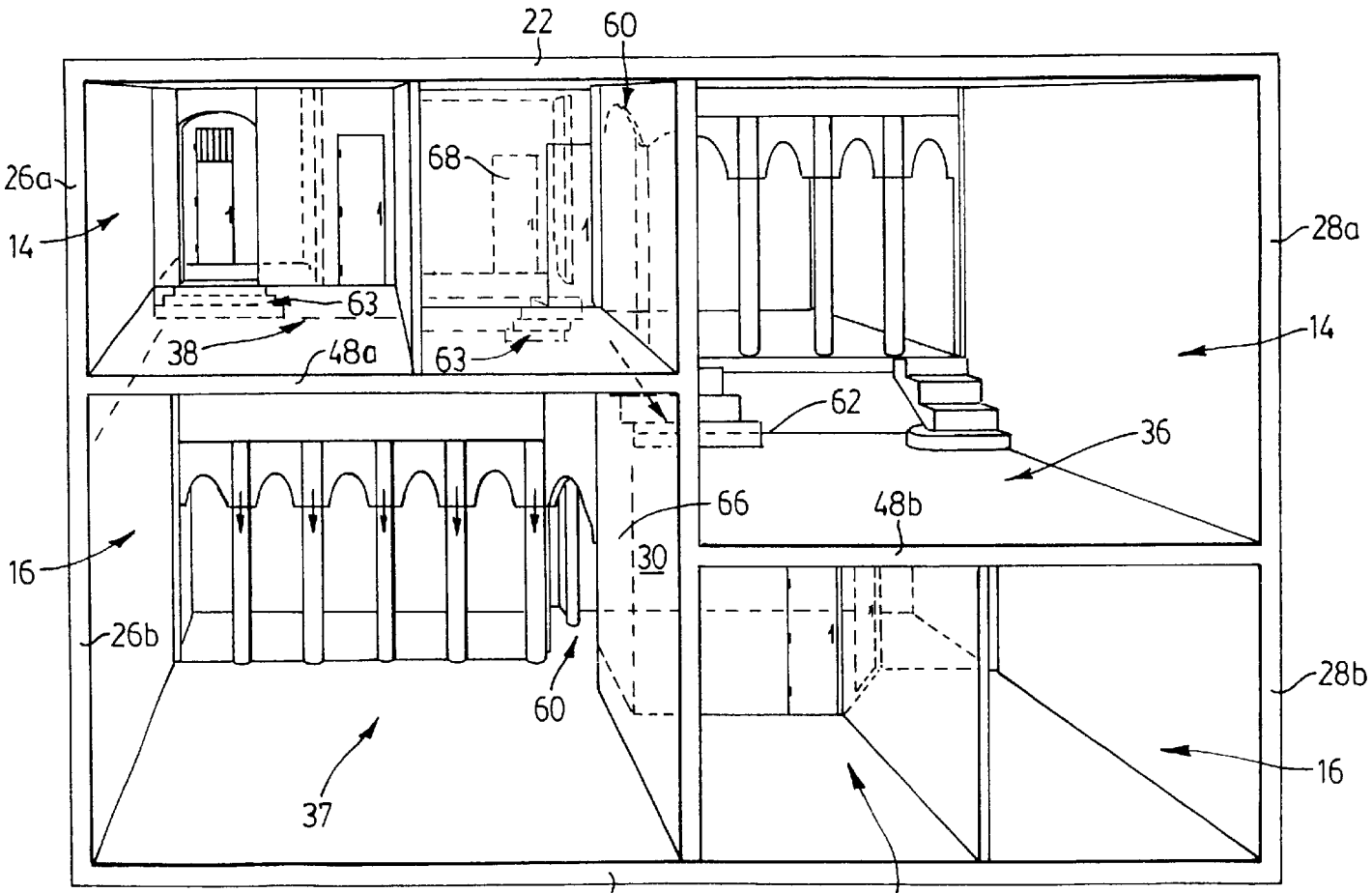
FIG. 11 shows a detailed front view of the layout of a single building construction module used in the building in FIG. 10.
Figure 12:
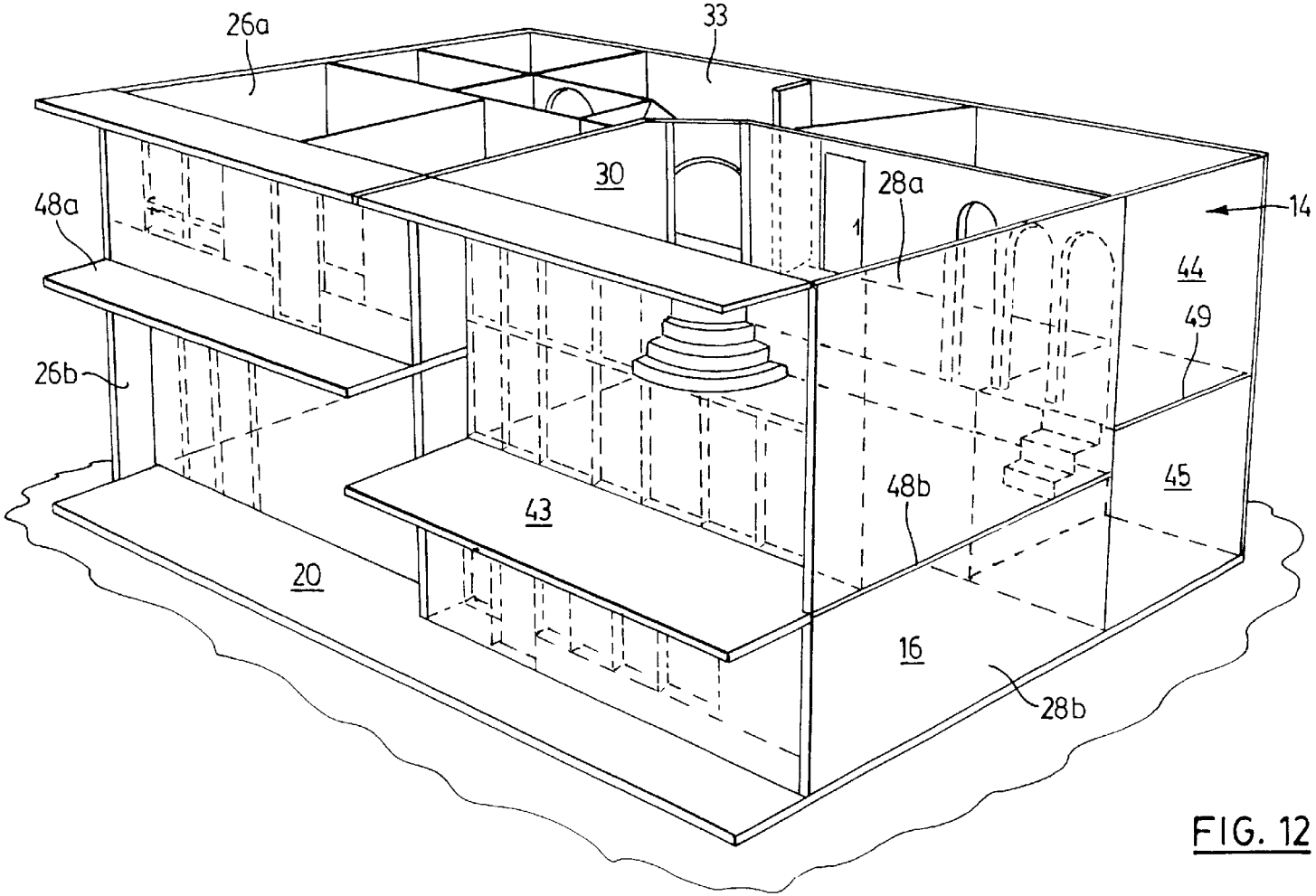
FIG. 12 shows a front perspective view of the module shown in FIG. 11.
Figure 13:
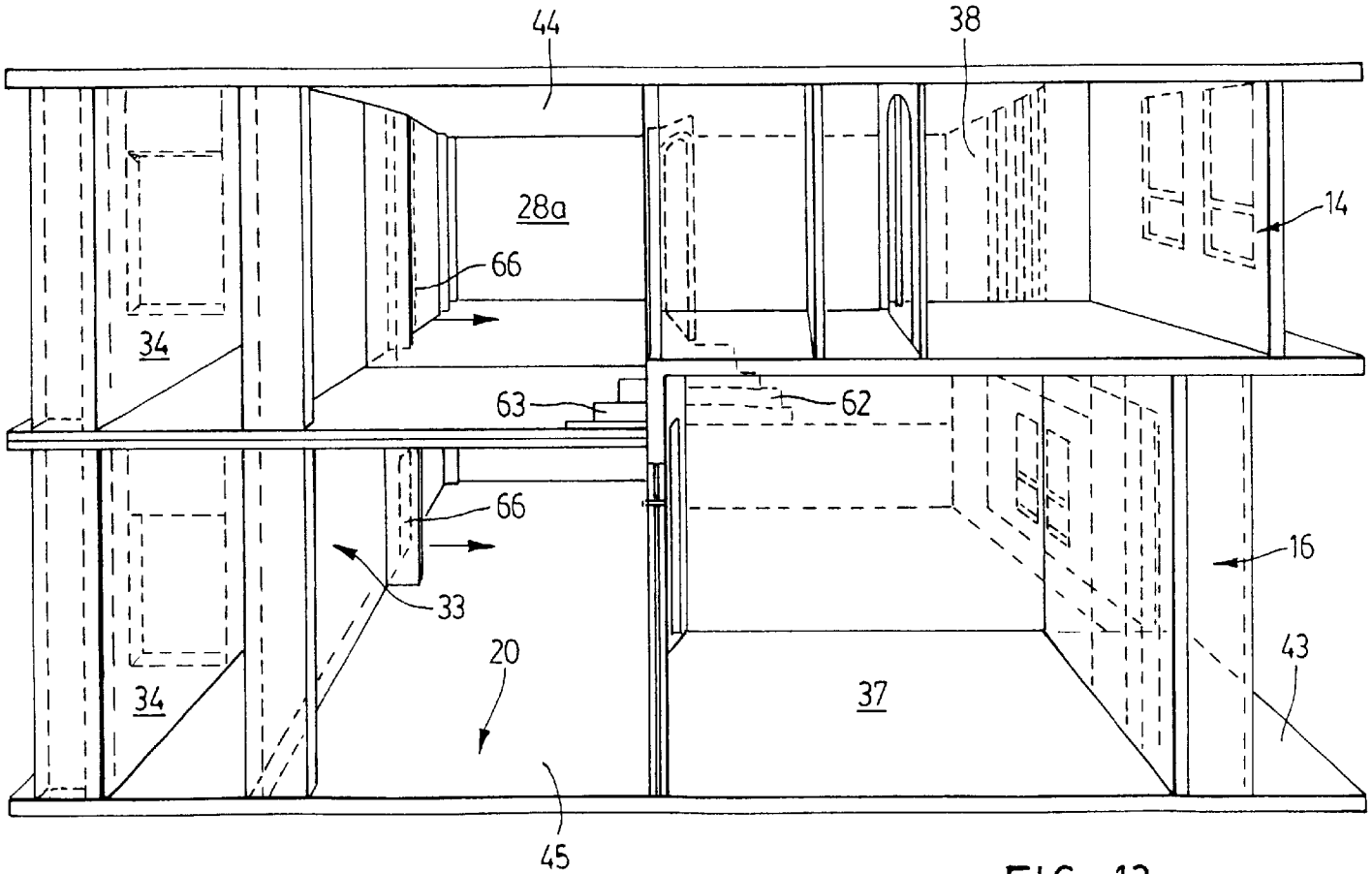
FIG. 13 illustrates a left or right side view of the building construction module used in the building of FIG. 10.

As shown best in FIG. 8, a stairwell 62 provides access between the primary living area 38 of the upper unit 14 and its secondary living area 28. FIG. 11 shows best the upper unit 14 as including additional stair riser units 63. The additional stair units 63 permit access between the primary living area 36 and the secondary living area 39. Depending on the layout of the building 8, additional stair units 63 may also be provided to facilitate access not only to exterior hallways, but between the living areas 36,38 or the hallway and bedrooms 76 as well.

Figure 17:
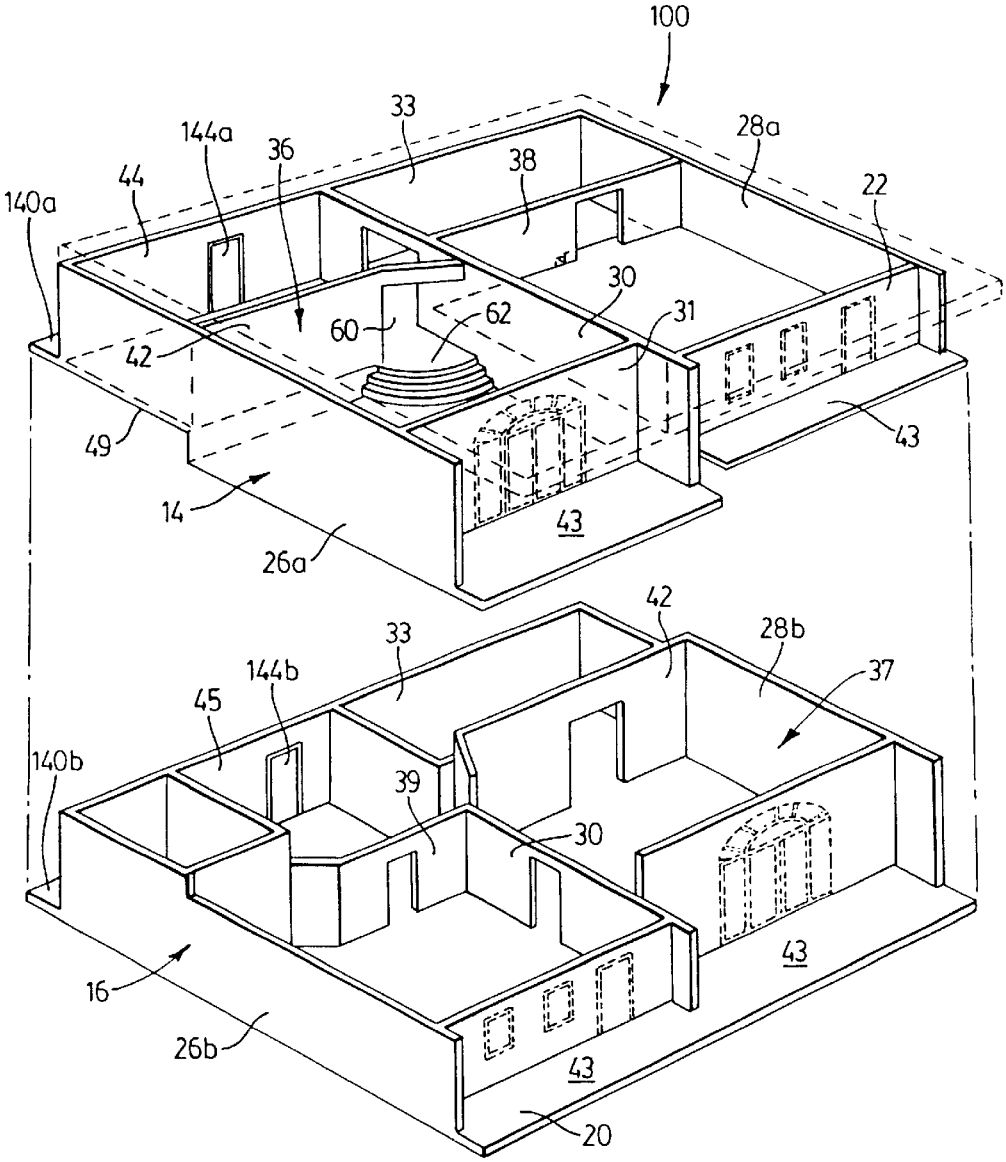
FIG. 17 shows an exploded perspective view of an alternate configuration of the Type B building Module used in the building of FIG. 10.

FIGS. 10 to 16 illustrate a module 100 which in the front view of FIG. 11 illustrates the primary living area 36 as being bordered by the sidewall 28. It is to be appreciated, however, that the module 100 could equally be formed in the mirror arrangement of FIG. 17. FIG. 17 illustrates best the building 8 as including a number of vertically spaced hallways 140*a*,140*b*. In one simplified construction, the uppermost hallway 140*a* is spaced approximately 1.25 stories above the lower hallway 140*b*, with access into and from each unit 14,16 from a respective hallway 140*a*, 140*b* through an access door 142*a*, 142*b*.

As with the units 14,16 of the module 10 shown in FIG. 1, in the module 100 one or more bedrooms 76, a kitchen 78 and bathrooms 74 are located within the rear hallway areas 44,45 and secondary living areas 38,39 of each unit 14,16.

Although FIGS. 2 and 10 illustrate buildings 8 which are composed entirely of a number of identical building construction modules 10,100, it is to be appreciated that the present invention may equally be provided as part of the building having other conventional one storey units. As indicated, the building modules 10,100 of the present invention could further be provided as either lowermost storeys of the building, the uppermost storeys of a building or for that matter, spaced at various mid-storeys as market forces may permit.

Figure 18:
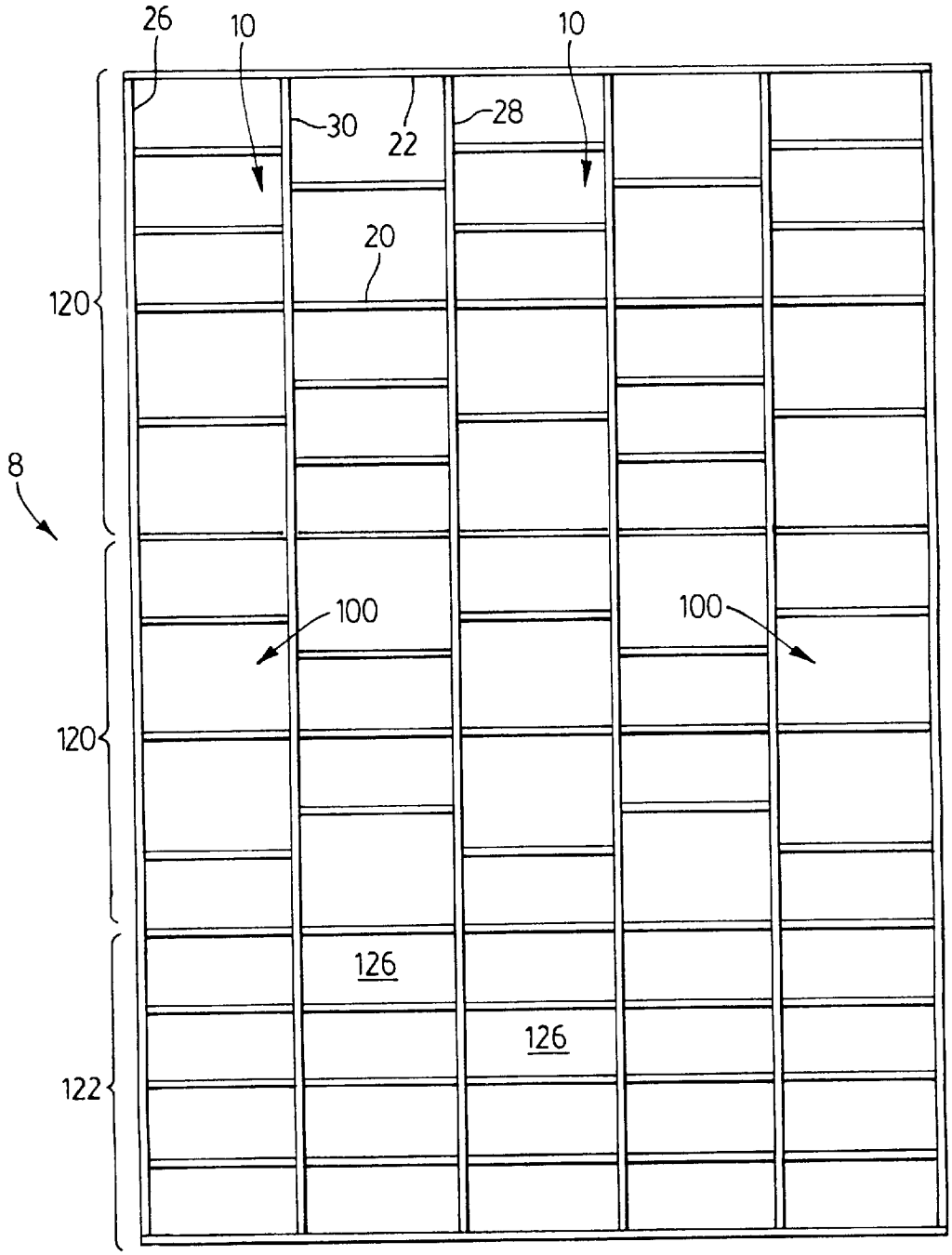
FIG. 18 illustrates schematically a front view of a building incorporating both building construction modules as shown in FIGS. 2 and 11, together with conventional one-story building units.

By way of non-limiting example, reference may be had to FIG. 18 which illustrates schematically one possible alternate high-rise building 8 in which like reference numerals are used to identify like components. The building 8 of FIG. 18 is shown as incorporating a number of the building modules 10 in accordance with the first embodiment of the invention, shown by reference numeral 120 as occupying the uppermost six storeys of the building 8, a number of modules 100, shown by reference numeral 122 as occupying the middle five storeys of the building 8, and a lowermost zone 124 of single conventional one storey residential units 126.

Figure 19:
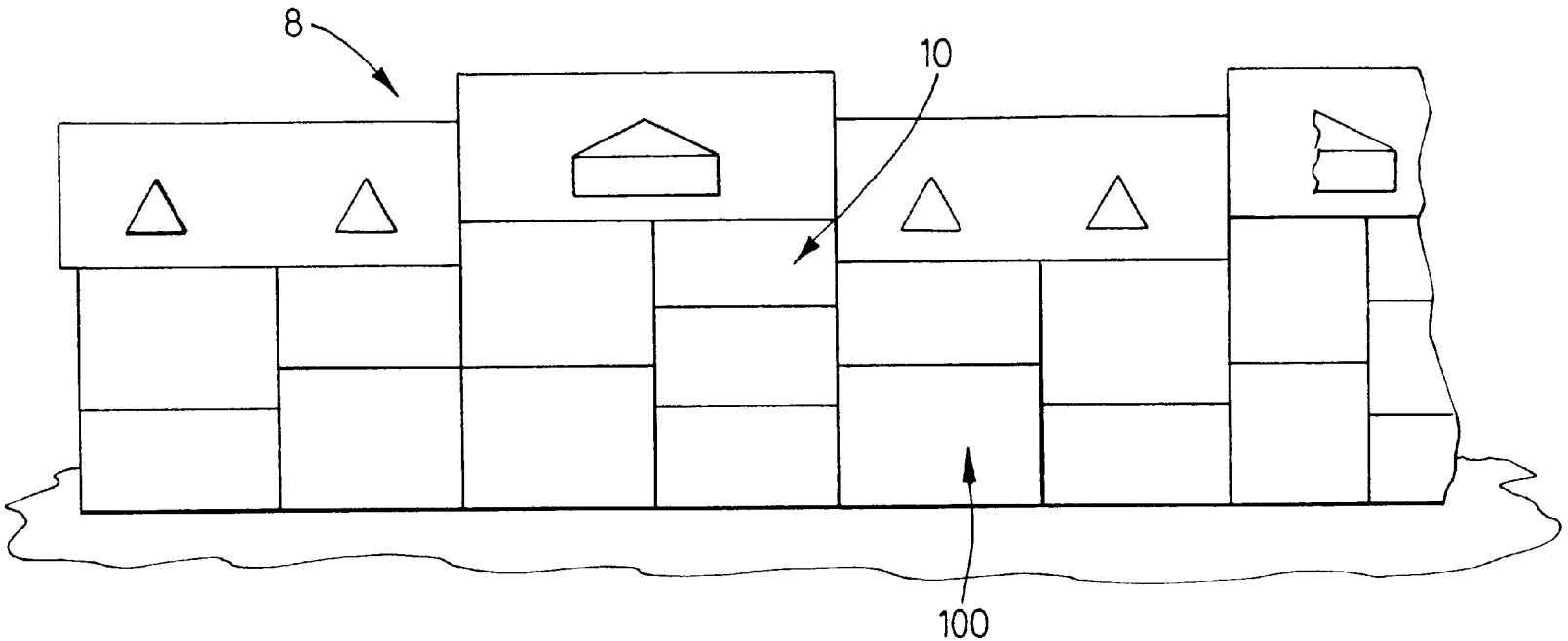
FIG. 19 illustrates schematically a front view of a town home incorporating both building construction modules A and B.

Although the detailed description describes the present construction modules as being used in concrete based structures, any brick or wood structure having a design appropriate for a model A or B module may be used in a townhome or detached home construction. By way of non-limiting example, FIG. 19 shows one such townhome construction in which like reference numerals are used to identify like components. In such a townhome or detached home construction, the modules (A or B) remain substantially of the same design, with a garage attached in front of each module.

Although the Figures illustrate various preferred embodiments, the invention is not so limited. Many variations and modifications will now occur to persons skilled in the art. For a definition of the invention, reference may be had to the appended claims

I claim:

1. An apartment, condominium building or townhouse construction comprising, a hallway area for providing access into or from the building, a pair of units each defining a self-contained living space spaced forwardly from the hallway area, a first one of said units being spaced vertically directly above the second other said unit, said first and second units being laterally defined by a pair of most preferably parallel vertically extending sidewalls, and further including an interior central dividing wall interposed between and most preferably parallel to said sidewalls, a first planar horizontal slab spanning between said sidewalls and defining an upper ceiling of said first unit, a second planar horizontal slab spaced about 2.5 storeys vertically beneath said first slab, said second slab spanning between said sidewalls and defining a lower floor of said second unit, each of said units further including a forwardmost principal living area defined laterally by a first one of said sidewalls and said dividing wall, and a forwardmost secondary living area defined laterally by the dividing wall and the second other one of said sidewalls, the principal living area of the first unit being spaced vertically directly above the forwardmost secondary living area of the second unit and separated therefrom by a horizontally extending principal area floor surface spanning between said dividing wall and said first sidewall, said principal area floor surface being located approximately one regular storey above said second slab and approximately 1.5 storeys below said first slab, the forwardmost secondary living area of the first unit being spaced directly above and separated from the primary living area of the second unit by a horizontally extending secondary floor surface spaced approximately one regular storey below said first slab and approximately 1.5 storeys above said second slab.

2. The building construction of claim 1 wherein said sidewalls and said dividing wall are load-bearing walls extending substantially the vertical height of the building.

3. The building construction of claim 1 wherein each of said units further comprises a rearward secondary living area located between the hallway area and at least one of the principal living area and the forwardmost secondary living area, the rearward secondary living area of the first unit being separated from the rearward living area of the second unit by a rear floor area spaced approximately 1.25 stories above said second slab.

4. The building construction as claimed in claim 3 wherein the rearward secondary living area of the first unit is spaced directly above the rearward secondary living area of the second unit, and being separated therefrom by the rear floor area.

5. The building construction as claimed in claim 4 wherein the rearward secondary living area of the second unit extends laterally between the vertically extending sidewalls.

6. The building construction of claim 5 wherein each of said slabs, said sidewalls and said dividing wall are of a poured concrete construction for apartment or condominium buildings and most preferably wood and brick structure for townhouse construction, and said first unit further includes a stair unit providing access between said upper and lower floors.

7. The building construction of claim 4 wherein each of said sidewalls are demising walls, said demising walls and said dividing wall are load bearing walls extending continuously substantially the vertical height of the apartment, condominium or townhouse construction.

8. The building construction of claim 7 wherein said first slab, said second slab and said demising walls are formed as concrete slabs for apartment or condominium buildings or most preferable from wood and brick structure for townhouse constructions.

9. The building construction as claimed in claim 3, wherein the rear portion of the first unit comprises an upper hallway and a lower hallway, the upper hallway extending between the forward most secondary living area of the first unit and a portion of the lower hallway located along the rearward secondary living area of the first unit, and the lower hallway extending between the sidewalls of said unit along the rearward portion of the principal living area of the first unit and the rearward portion of the secondary living area of the first unit;

wherein at least one staircase and door permit movement from the upper hallway into the lower hallway and another staircase permits movement from the lower hallway into the principal living room of said first unit;

wherein at least one doorway permits movement from the upper hallway of the first unit into the forward most secondary living area of the first unit;

wherein accessibility into said first unit is permitted by an entrance doorway located between a common hallway area of the building and the lower hallway of the first unit and wherein most preferably there are no stairs between said common hallway area of the building and said lower hallway of the first unit.

10. The building construction of claim 3 wherein the first unit further includes a stairway assembly extending from the rearward secondary living area into at least one of the primary living area and the forwardmost secondary living area.

11. The building construction of claim 1 wherein said first and second units occupy the uppermost, lowermost or any floor level of a condominium or apartment building, and wherein each of said units substantially defines a self-contained living space.

12. An apartment, condominium building or townhouse construction comprising, a hallway area including upper and lower vertically adjacent hallways, a pair of units each defining a self-contained living space adjacent to the hallway area, a first one of said units being spaced vertically directly above the second other said unit, said first and second units being laterally defined by a pair of most preferably parallel vertically extending sidewalls, and further including an interior central dividing wall interposed between and most preferably parallel to said sidewalls, a first planar horizontal surface spanning between said sidewalls and defining an upper ceiling of said first unit, a second planar horizontal surface spaced about 2.5 storeys vertically beneath said first surface, said second surface spanning between said sidewalls and defining a lower floor of said second unit, each of said units further including a forwardmost principal living area defined laterally by a first one of said sidewalls and said dividing wall, and a forwardmost secondary living area defined laterally by the dividing wall and the second other one of said sidewalls, the principal living area of the first unit being spaced vertically directly above the forwardmost secondary living area of the second unit and separated therefrom by a horizontally extending principal area floor surface spanning between said dividing wall and said first sidewall, said principal area floor surface being located approximately one regular storey above said lower floor, the forwardmost secondary living area of the first unit being spaced directly above and separated from the primary living area of the second unit by a horizontally extending secondary floor surface spaced approximately one regular storey below said upper ceiling of the first unit; and wherein each of said units further comprises a rearward secondary living area, the rearward secondary living area of each unit being located between the building hallway and the rearward portion of the principal living area and the rearward portion of the secondary living area for the said first unit and said second unit.

13. The building construction of claim 12 wherein said sidewalls and said dividing wall are load-bearing walls extending substantially the vertical height of the building.

14. The building construction of claim 12 wherein the rearward secondary living area of the first unit being separated from the second unit by a rear floor area spaced approximately 1.25 stories above said lower floor.

15. The building construction as claimed in claim 14 wherein the rearward secondary living area of the first unit is spaced substantially above the rearward secondary living area of the second unit, and being separated therefrom by the rear floor area.

16. The building construction as claimed in claim 12 wherein the rearward secondary living area of each of the first and second units extends laterally between the vertically extending sidewalls.

17. A building structure comprising, at least one pair of units defining a self-contained space, a hallway area for providing access into or from a selected one of the units, the pair of units spaced forwardly from the hallway area, a first one of said units being spaced vertically directly above the second other said unit, said first and second units being laterally defined by a pair of most preferably parallel vertically extending sidewalls, and further including an interior central dividing wall interposed between and most preferably parallel to said sidewalls, a first planar horizontal slab spanning between said sidewalls and defining an upper ceiling of said first unit, a second planar horizontal slab spaced about 2.5 storeys vertically beneath said first slab, said second slab spanning between said sidewalls and defining a lower floor of said second unit, each of said units further including a forwardmost principal living area defined laterally by a first one of said sidewalls and said dividing wall, a forwardmost secondary living area defined laterally by the dividing wall and the second other one of said sidewalls and a rearward secondary living area located between the hallway area and at least one of the principal living area and the forwardmost secondary living area, the principal living area of the first unit being spaced vertically directly above the forwardmost secondary living area of the second unit and separated therefrom by a horizontally extending principal area floor surface spanning between said dividing wall and said first sidewall, said principal area floor surface being located approximately one regular storey above said second planar horizontal slab and 1.5 storeys below said first planar horizontal slab, the forwardmost secondary living area of the first unit being spaced directly above and separated from the primary living area of the second unit by a horizontally extending secondary floor surface spaced approximately 1.5 storeys above said second planar horizontal slab and one regular storey below said first planar horizontal slab, and wherein the hallway area of the first unit comprises a pair of vertically spaced upper and lower hallways, the upper hallway extending along at least part of the rearward secondary living area of the first unit, and the lower hallway extending along at least part of the rearward secondary living area of the first unit and along the rearward portion of the principal living area of the first unit, at least one doorway permitting movement from the upper hallway into the rearward secondary living area of the first unit.

18. The building structure of claim 17 wherein the rearward secondary living area of the first unit being separated from the second unit by a rear floor area spaced approximately 1.25 stories above said second slab.

19. The building structure as claimed in claim 18 wherein the rearward secondary living area of the first unit is spaced directly above the rearward secondary living area of the second unit, and being separated therefrom by the rear floor area.

* * * * *